US005459023A

United States Patent [19]

Yamada et al.

[11] Patent Number: 5,459,023

[45] Date of Patent: Oct. 17, 1995

[54] SILVER HALIDE COLOR PHOTOGRAPHIC MATERIAL

[75] Inventors: Kohzaburoh Yamada; Yasuhiro Yoshioka, both of Minami-ashigara, Japan

[73] Assignee: Fuji Photo Film Co., Ltd., Kanagawa, Japan

[21] Appl. No.: 338,145

[22] Filed: Nov. 9, 1994

[30] Foreign Application Priority Data

Nov. 12, 1993 [JP] Japan ..... 5-306000

[51] Int. Cl.[6] ..... G03C 7/392

[52] U.S. Cl. ..... 430/551; 430/610; 430/613

[58] Field of Search ..... 430/609, 610, 430/613, 551

[56] References Cited

U.S. PATENT DOCUMENTS 4,749,645 6/1988 Goddard et al. ..... 430/551
5,035,988 7/1991 Nakamura et al. ..... 430/610

FOREIGN PATENT DOCUMENTS 3142445 6/1991 Japan ..... 430/610

*Primary Examiner*—Lee C. Wright
*Attorney, Agent, or Firm*—Birch, Stewart, Kolasch & Birch

[57] ABSTRACT

A silver halide color photographic material comprising a support having thereon at least one layer containing at least one compound represented by formula (I)

(I)

wherein $R_1$, $R_2$, $R_3$ and $R_4$ each represents a hydrogen atom or a substituent; $R_5$ and $R_6$ each represents a substituent; m and n each represents an integer of from 0 to 4; provided that said compound of formula (I) has a phosphonic acid ester moiety or a phosphonic acid amide moiety, wherein the carbon atom of the C-P bond contained in said moiety (i) constitutes a part of the skeleton of said compound of formula (I), said skeleton being represented by formula (A)

(A)

or (ii) is contained in a substituent group represented by $R_1$, $R_2$, $R_3$, $R_4$, $R_5$, or $R_6$; wherein two or more of $R_1$ to $R_6$ may combine with said phosphonic acid ester or amide moiety to form a ring.

11 Claims, No Drawings

SILVER HALIDE COLOR PHOTOGRAPHIC MATERIAL

FIELD OF THE INVENTION

The present invention relates to a silver halide color photographic material.

BACKGROUND OF THE INVENTION

A silver halide color photographic material (hereinafter sometimes referred to as a photographic material simply) generally has silver halide emulsion layers sensitive to three primary colors, i.e., red, green and blue. Color reproduction is achieved by the subtractive process by incorporating three kinds of color couplers in the emulsion layers. The color couplers are capable of forming dyes, each of which has a complementary color relationship to color to which the corresponding emulsion layer is sensitive. Color images which are obtained by photographically processing this photographic material generally comprise an azomethine dye or an indoaniline dye formed by a reaction of the oxidation product of an aromatic primary amine developing agent with the coupler.

The thus-obtained color images are not necessarily stable against light, humidity and temperature, and the discoloration of color images are liable to occur when exposed to light or stored under high humidity and high temperature conditions for a long period of time, leading to the degradation of color images.

These kinds of discolorations are fatal to recording materials. Various countermeasures against these drawbacks are proposed, such as the development of couplers having a high stability of dye obtained, the usage of discoloration inhibitors and UV absorbing agents to prevent the degradation of images by ultraviolet rays.

The effect of discoloration inhibitors to prevent the degradation of images is great of the above measures. Specific examples of discoloration inhibitors which can be used include hydroquinones, hindered phenols, catechols, gallic acid esters, aminophenols, hindered amines, chromanols, indanes, and ether or ester derivatives obtained by silylating, acylating or alkylating the phenolic hydroxyl groups of the above compounds, in addition, metal complexes can also be used.

These compounds have effects as discoloration inhibitors of color images but are insufficient to meet the demands of users who have required high quality images. Moreover, some of them adversely affect photographic characteristics, such as they cause considerable extent of color stains in the white background area, they cause coloring of the unexposed area (hereinafter, referred to as fog), they cause hindrance of coloring of couplers, they react with the oxidation product of a developing agent at the time of color development to form dyes leading to a cause of color turbidity, and they alter the original hue obtained by the couplers. Further, these compounds sometimes cause insufficient dispersion, or generate crystallites after emulsion coating, therefore, they are not comprehensively effective as discoloration inhibitors for color photographic use.

Compounds having bisphenol structures are also known as image degradation inhibitors. These compounds, although effective as discoloration inhibitors, have problems such as they cause lowering of coloring when used in a large amount for the purpose of satisfying recent strong demands for high stability of color images, cause yellow stains in the white background area with the lapse of time, and react with the oxidation product of a developing agent at the time of development to form dyes resulting in a cause of color turbidity.

SUMMARY OF THE INVENTION

An object of the present invention is to provide a photographic material having a high storability and the color image of which is not discolored for a long period of time.

Another object of the present invention is to provide a photographic material containing photographic additives which do not alter the hue of the color image obtained, do not react with the oxidation product of a developing agent at the time of development to form a dye leading to a cause of color turbidity, do not lower the color density, and have sufficient effect of preventing discoloration of the color image.

A further object of the present invention is to provide a photographic material containing photographic additives which are excellent in solubility to a high boiling point organic solvent and do not have mal-effects on coloring ability of a color forming coupler and other photographic additives.

A still Further object of the present invention is to provide a photographic material with a high storability which contains photographic additives which do not cause discoloration of the color image formed by a color forming coupler with the lapse of long time and do not cause yellow stains in the white background area with the lapse of time.

As a result of various studies, the present inventors discovered that the above objects are attained by the following means:

(1) A silver halide color photographic material comprising a support having thereon at least one layer containing at least one compound represented by formula (I)

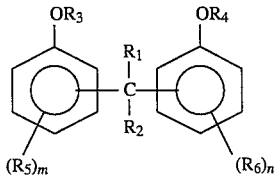

(I)

wherein $R_1$, $R_2$, $R_3$ and $R_4$ each represents a hydrogen atom or a substituent; $R_5$ and $R_6$ each represents a substituent; m and n each represents an integer of from 0 to 4; provided that said compound of formula (I) has a phosphonic acid ester moiety of the formula

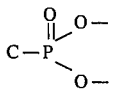

or a phosphonic acid amide moiety of the formula

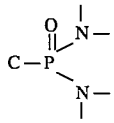

wherein the carbon atom of the C-P bond contained in said moiety (i) constitutes a part of the skeleton of said compound of formula (I), said skeleton being represented by formula (A) (hereinafter referred to as Skeleton (A))

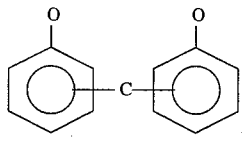

(A)

or (ii) is contained in a substituent group represented by $R_1$, $R_2$, $R_3$, $R_4$, $R_5$, or $R_6$; wherein two or more of $R_1$ to $R_6$ may combine with said phosphonic acid ester or amide moiety to form a ring.

(2) A silver halide color photographic material comprising a support having thereon at least one layer containing at least one compound represented by formula (I-1), (I-2), (I-3), (I-4), (I-5) or (I-6):

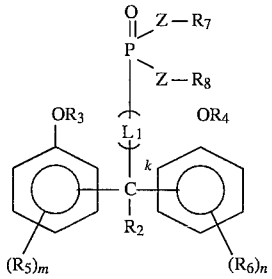

(I-1)

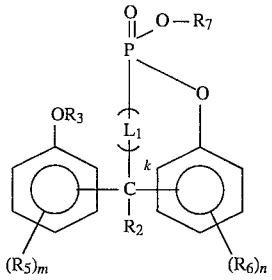

(I-2)

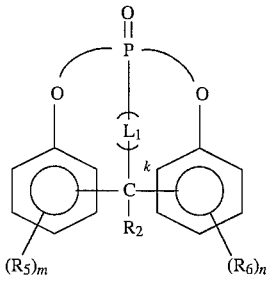

(I-3)

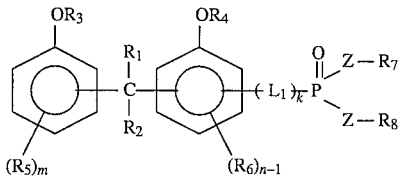

(I-4)

-continued

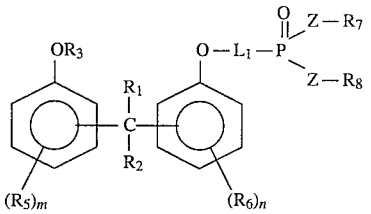

(I-5)

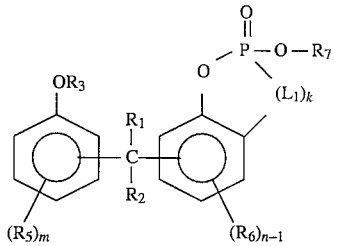

(I-6)

wherein $R_1$, $R_2$, $R_3$ and $R_4$ each represents a hydrogen atom or a substituent; $R_5$ and $R_6$ each represents a substituent; m and n each represents an integer of from 0 to 4; $L_1$ represents a divalent linking group connected by a P atom and a C atom in each formula; k represents an integer of 0 or 1; Z represents —0— or —N—($R_9$)—; $R_7$, $R_8$ and $R_9$ each represents an alkyl group, a cycloalkyl group, an alkenyl group, or an aryl group; in each formula, at least two of $R_1$, $R_2$, $R_3$, $R_4$, $R_5$, $R_6$, $R_7$, $R_8$ and $R_9$ may be bonded each other to form a ring.

DETAILED DESCRIPTION OF THE INVENTION

The present invention is described in detail below.

The compound represented by formula (I) of the present invention (including compounds represented by formulae (I-1), (I-2), (I-3), (I-4), (I-5) and (I-6)) (hereinafter referred to as the compound of the present invention) is a compound for inhibiting discoloration of a color image formed by a coupler and which is non-coloring compound. "Non-coloring compound" means a compound which does not substantially provide a color when processed with a color developing solution.

The compound represented by formula (I) of the present invention is conspicuously characterized in that it has a phosphonic acid ester moiety or a phosphonic acid amide moiety in the molecule as a partial structure.

The phosphonic acid-ester moiety and the phosphonic acid amide moiety of the present invention are described below:

Phosphonic acid ester moiety

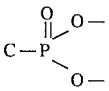

Phosphonic acid amide moiety

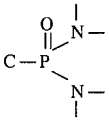

This phosphonic acid ester moiety or phosphonic acid amide moiety, as described above, exists in the molecule of the compound such that the carbon atom of P-C bond in the phosphonic acid ester moiety or the phosphonic acid amide moiety constitutes a part of Skeleton (A) or is contained in a substituent group represented by $R_1$ to $R_6$. Compounds included in this definition are, for example, a compound in which the phosphorus atom of P-C bond is directly bonded to a carbon atom in Skeleton (A), or a compound in which the phosphorus atom is bonded to a carbon atom in substituent $R_1$, $R_2$, $R_3$, $R_4$, $R_5$ or $R_6$ in formula (I). Any compound represented by formula (I) may be the compound of the present invention as long as it includes the above P-C relationship, and the phosphonic acid ester moiety may be the oxygen atom in Skeleton (A).

The compound of the present invention represented by formula (I) is preferably represented by the above-described formula (I-1), (I-2), (I-3), (I-4), (I-5) or (I-6).

$R_1$, $R_2$, $R_3$, $R_4$, $R_5$ and $R_6$ each represents a substituent which can be substituted. Examples of substituents include a halogen atom, an alkyl group, an alkenyl group, a cycloalkyl group, an aryl group, a heterocyclic group, an acyl group, an acyloxy group, an acylamino group, an alkoxy group, an aryloxy group, an alkoxycarbonyl group, an aryloxycarbonyl group, a carbamoyl group, a sulfonyl group, a sulfonyloxy group, a sulfamoyl .group, a sulfonamide group, an amino group, an alkoxycarbonylamino group, an aryloxycarbonylamino group, a sulfinyl group, an alkylthio group, an arylthio group, a hydroxy group, a cyano group, a nitro group, a sulfo group, a carbamoylamino group, a sulfamoylamino group, a sulfamoylcarbamoyl group, a carbamoylsulfamoyl group, a dialkyloxyphosphinyl group, a diaryloxyphosphinyl group, a dialkenyloxyphosphinyl group, dicycloalkyloxyphosphinyl group, a diaminophosphinyl group, and a phosphino group. These substituents may be substituted with the above substituents.

Each of the substituents represented by $R_1$ to $R_6$may be substituted by a phosphonic acid ester or a phosphonic acid amide.

Specific examples of $R_1$, $R_2$, $R_3$, $R_4$, $R_5$ and $R_6$ include a halogen atom (e.g., a chlorine atom, a bromine atom, a fluorine atom), an alkyl group (preferably having from 1 to 50, more preferably from 1 to 30, carbon atoms, e.g., methyl, ethyl, n-propyl, i-propyl, n-butyl, t-butyl, hexyl, 2-ethylhexyl, octyl, nonyl, decyl, dodecyl, octadecyl, benzyl), an alkenyl group (preferably having from 2 to 30 carbon atoms, e.g., allyl), a cycloalkyl group (preferably having from 3 to 30 carbon atoms, e.g., cyclopropyl, cyclohexyl), an aryl group (preferably having from 6 to 36 carbon atoms, e.g., phenyl, 4-methoxyphenyl), a heterocyclic group (preferably having from 0 to 36 carbon atoms, a nitrogen atom, an oxygen atom, a sulfur atom, and a phosphorus atom are preferred as a hetero atom, and preferably from a 5- to 7-membered ring, e.g., imidazolyl, pyrazolyl, furfuryl, thienyl), an acyl group (preferably an alkylacyl group having from 2 to 31 carbon atoms or an arylacyl group having from 7 to 36 carbon atoms, e.g., acetyl, benzoyl), an acyloxy group (preferably an alkylacyloxy group having from 2 to 31 carbon atoms or an arylacyloxy group having from 7 to 36 carbon atoms, e.g., acetyloxy, benzoyloxy), an acylamino group (preferably an alkylacylamino group having from 2 to 31 carbon atoms or an arylacylamino group having from 7 to 36 carbon atoms, e.g., acetamino, pivaloylamino, tetradecanoylamino, benzoylamino, 4-dodecyloxybenzoylamino), an alkoxy group (preferably having from 1 to 31 carbon atoms, e.g., methoxy, ethoxy, i-propyloxy, hexadecyloxy), an aryloxy group (preferably having from 6 to 36 carbon atoms, e.g., phenoxy, 4-methoxyphenoxy), an alkoxycarbonyl group (preferably having from 2 to 36 carbon atoms, e.g., methoxycarbonyl, ethoxycarbonyl), an aryloxycarbonyl group (preferably having from 7 to 36 carbon atoms, e.g., phenoxycarbonyl), a carbamoyl group (preferably having from 1 to 36 carbon atoms, e.g., carbamoyl, N-methylcarbamoyl, N-phenylcarbamoyl, N,N-dimethylcarbamoyl), a sulfonyl group (preferably an alkanesulfonyl group having from 0 to 36 carbon atoms or an arylsulfonyl group having from 6 to 36 carbon atoms, e.g., methanesulfonyl, phenylsulfonyl), a sulfonyloxy group (preferably an alkanesulfonyloxy group having from 0 to 36 carbon atoms or an arylsulfonyloxy group having from 6 to 36 carbon atoms, e.g., methanesulfonyloxy, phenylsulfonyloxy), a sulfamoyl group (preferably having 0 to 36 carbon atoms, e.g., sulfamoyl, N-methylsulfamoyl, N-phenylsulfamoyl, N,N-dimethylsulfamoyl), a sulfonamide group (preferably an alkylsulfonamide group having from 0 to 36 carbon atoms or an arylsulfonamide group having from 6 to 36 carbon atoms, e.g., methanesulfonamide, phenylsulfonamide), an amino group, an alkoxycarbonylamino group (preferably having from 2 to 32 carbon atoms, e.g., methoxycarbonylamino), an aryloxycarbonylamino group (preferably having from 7 to 36 carbon atoms, e.g., phenoxycarbonylamino), a sulfinyl group (preferably an alkylsulfinyl group having from 0 to 36 carbon atoms or an arylsulfinyl group having from 6 to 36 carbon atoms, e.g., methanesulfinyl), an alkylthio group (preferably having from 1 to 31 carbon atoms, e.g., methylthio, ethylthio, t-butylthio), an arylthio group (preferably having from 6 to 36 carbon atoms, e.g., phenylthio, 4-methoxyphenylthio), a hydroxy group, a cyano group, a nitro group, a sulfo group, a carbamoylamino group (preferably having from 1 to 36 carbon atoms, e.g., carbamoylamino, N-methylcarbamoylamino), a sulfamoylamino group (preferably having from 0 to 30 carbon atoms, e.g., N-methylsulfamoylamino), a sulfamoylcarbamoyl group (preferably having from 1 to 31 carbon atoms, e.g., methanesulfamoylcarbamoyl), a carbamoylsulfamoyl group (preferably having from 1 to 36 carbon atoms, e.g., methanecarbamoylsulfamoyl), a dialkyloxyphosphinyl group (preferably having from 2 to 32 carbon atoms, e.g., dimethyloxyphosphinyl, diethyloxyphosphinyl, dibutyloxyphosphinyl, di(2-ethylhexyloxyphosphinyl, dioctyloxyphosphinyl, didodecyloxyphosphinyl), a diaryloxyphosphinyl group (preferably having from 12 to 36 carbon atoms, e.g., diphenyloxyphosphinyl), a dialkenyloxyphosphinyl group (preferably having from 4 to 34 carbon atoms, e.g., diaryloxyphosphinyl), a dicycloalkyloxyphosphinyl group (preferably having from 12 to 36 carbon atoms, e.g., dicyclohexyloxyphosphinyl), a diaminophosphinyl group (preferably having from 0 to 36 carbon atoms, e.g., diethylaminophosphinyl, dibutylaminophosphinyl), a phosphino group.

$R_3$ and R4 each preferably represents a hydrogen atom, an alkyl group, an alkenyl group, an aryl group, or a protecting group capable of deblocking under alkaline conditions (e.g., an acyl group, a phosphino group, a sulfonyl group, an alkoxycarbonyl group, etc.). $R_3$ most preferably represents a hydrogen atom.

$R_1$ and R2 each preferably represents a hydrogen atom, an alkyl group, an aryl group, a dialkyloxyphosphinyl group, a diaryloxyphosphinyl group, a dialkenyloxyphosphinyl group, a dicycloalkyloxyphosphinyl group, or a diaminophosphinyl group. $R_1$ preferably represents an alkyl group, a dialkyloxyphosphinyl group, a diaryloxyphosphinyl group, a dialkenyloxyphosphinyl group, a dicycloalkyloxyphosphinyl group, or a diaminophosphinyl group. $R_2$ most preferably a hydrogen atom.

$R_5$ and $R_6$ each preferably represents an alkyl group, an alkenyl group, an aryl group, an alkoxycarbonyl group, an aryloxycarbonyl group, an acyl group, a halogen atom, a sulfonyl group, a carbamoyl group, a sulfamoyl group, an acylamino group, a sulfonamide group, an alkoxy group, an alkylthio group, an amino group, a dialkyloxyphosphinyl group, a diaryloxyphosphinyl group, a dialkenyloxyphosphinyl group, a dicycloalkyloxyphosphinyl group, or a diaminophosphinyl group.

m and n each represents an integer of from 0 to 4. n is not 0 in formulae (I-4) and (I-6). m and n preferably represents 2 in the present invention.

A preferred compound represented by formula (I) includes a compound where the carbon atom by which $R_1$ and $R_2$ are connected bonds to each benzene ring at the ortho-position or para-position thereof to the —$OR_3$ group and the —$OR_4$ group, particularly preferably at the ortho-position.

The alkyl group, the alkenyl group, the cycloalkyl group, and the aryl group represented by $R_7$, $R_8$ and $R_9$ have the same meanings as in the definition of $R_1$ to $R_6$.

$L_1$ represents a divalent linking group connected by a phosphorus atom and a carbon atom, and examples thereof include an alkylene group (preferably having from 1 to 20, more preferably from 1 to 10, carbon atoms, e.g., methylene, ethylene, 1,2-propylene, 1,3-propylene, butylene), an alkenylene group (preferably having from 2 to 10 carbon atoms, e.g., vinylene), a cycloalkylene group (preferably having from 3 to 10 carbon atoms, e.g., 1,2-cyclohexylene, 1,4-cyclohexylene), and an arylene group (preferably having from 6 to 20 carbon atoms, e.g., 1,2-phenylene), preferably an alkylene group.

A compound having a phosphonic acid ester moiety is preferred in the present invention. In formulae (I-1) to (I-6), a compound wherein Z represents —O— is preferred.

Of formulae (I-1) to (I-6), formulae (I-1), (I-2), (I-4), (I-5) and (I-6) are preferred, and formula (I-1), (I-2) and (I-6) are more preferred.

Specific examples of these compounds are described below. However, the present invention is not limited thereto.

1.

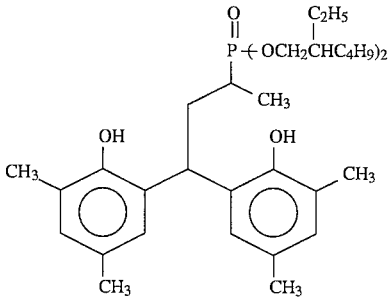

-continued

2.

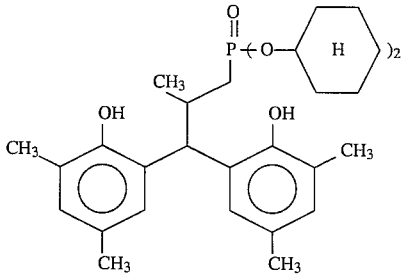

3.

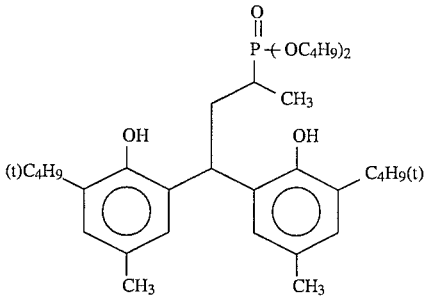

4.

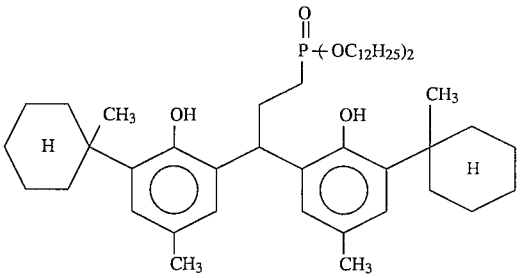

5.

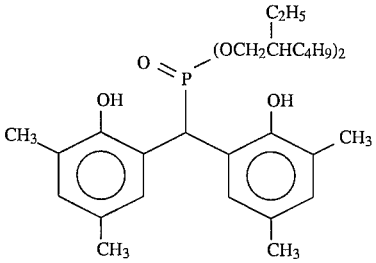

6.

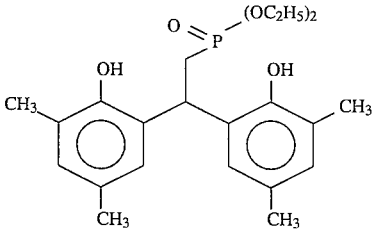

-continued
7.
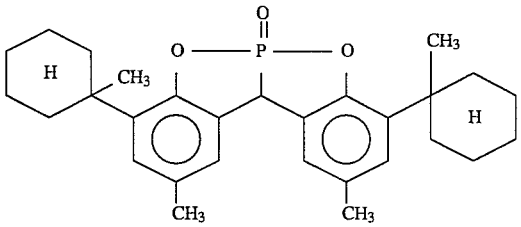
8.
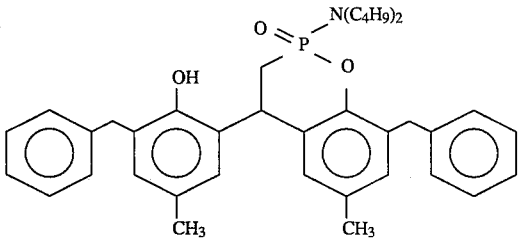
9.
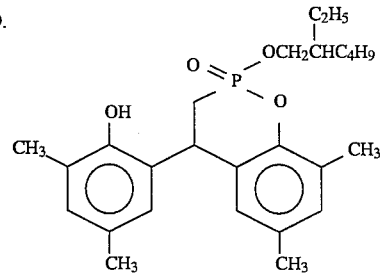
10.
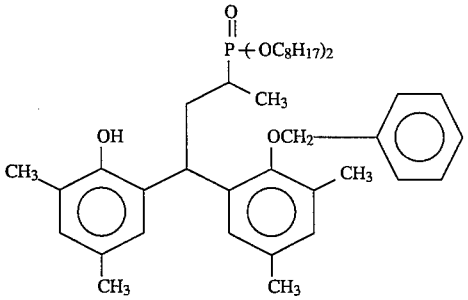
11.
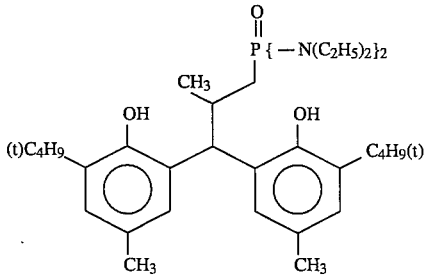
12.
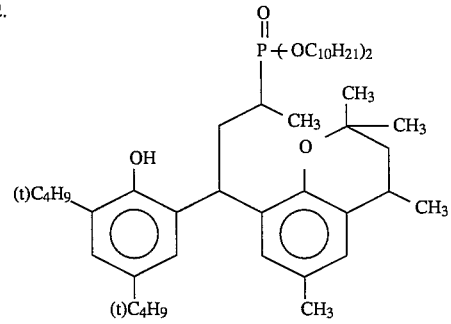
-continued
13.
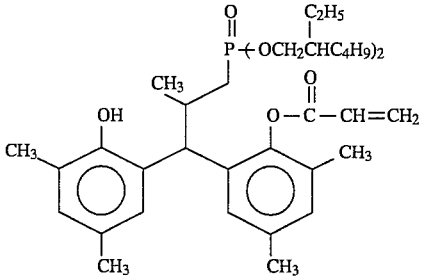
14.
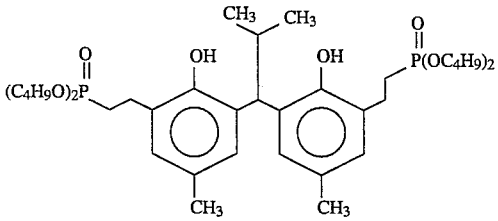
15.
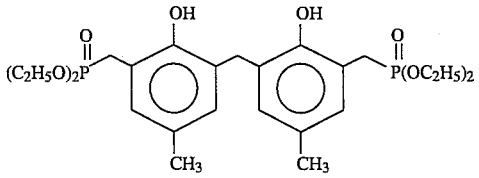
16.
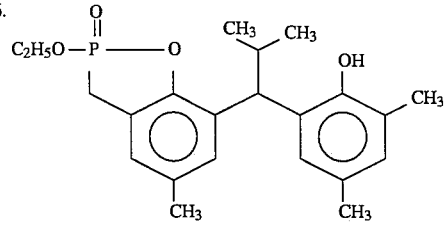
17.
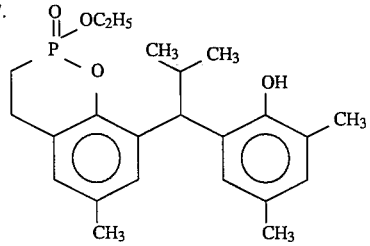
18.
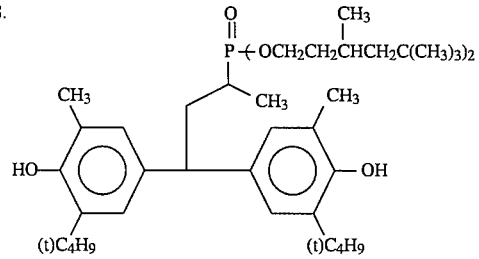

-continued
19.
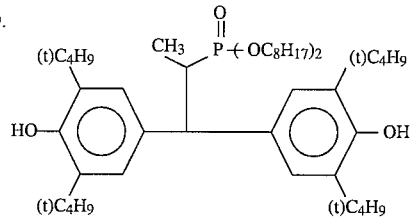
20.
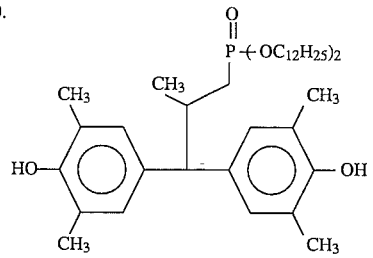
21.
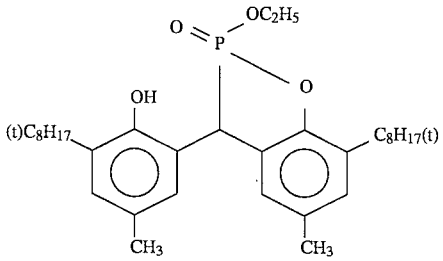
22.
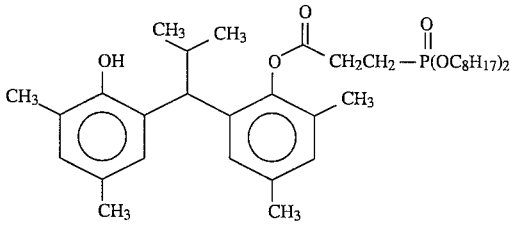
23.
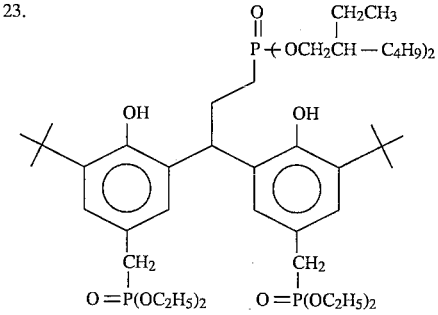
24.
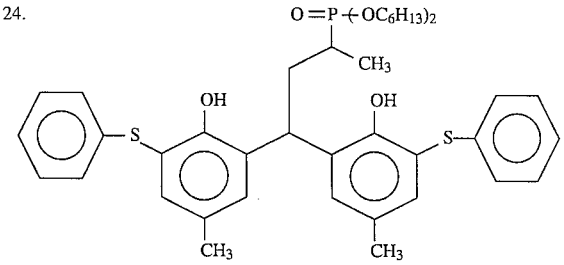
-continued
25.
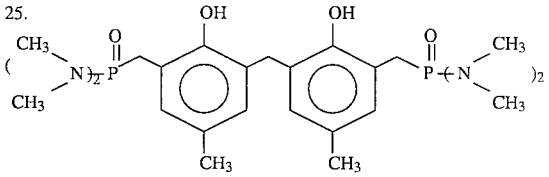
26.
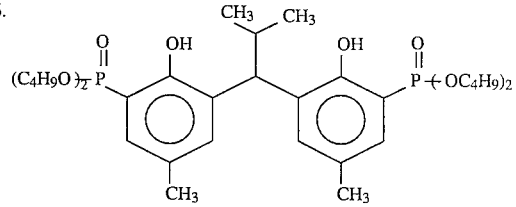
27.
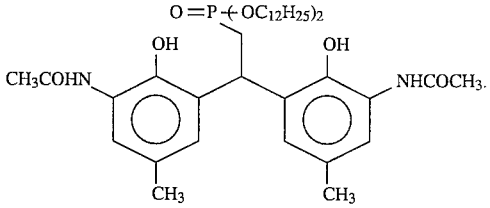
Of them, Compounds 1 to 6, 9, 10, 13, 21 are preferred.
SYNTHESIS EXAMPLES
Synthesis of Compound 1
Compound 1 was synthesized according to Scheme 1.
Scheme 1
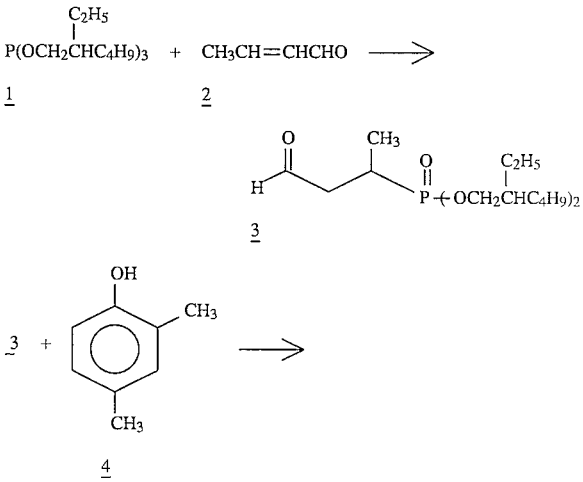

-continued
Scheme 1

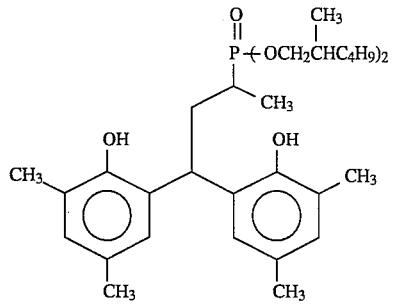

Compound 1

Synthesis of 3-di(2'-ethylhexyl)oxyphosphinylbutanal (3)

75.8 g of tri-2-ethylhexylphosphite, 15.0 ml of crotonaldehyde and 46.0 g of phenol were mixed and heated in an oil bath of 130° C. for 3 hours. The reaction product was distilled by a vacuum pump under a reduced pressure to remove excessive phenol or the like. The distillation residue was dissolved in a mixed solution of acetone and hydrochloric acid and heated under reflux. An objective crude oil product of 3-di(2'-ethylhexyl)oxyphosphinylbutanal was obtained by an ordinary post-treatment method. The crude product was purified by distillation to obtain 47.6 g of an oily product.

Synthesis of Compound 1

5.29 g of 3-di(2'-ethylhexyl)oxyphosphinylbutanal and 3.44 g of 2,4-dimethylphenol were mixed with 10 ml of acetic acid, and 2 ml of concentrated sulfuric acid was dropwise added thereto.

This solution was post-treated in an ordinary method, purified by column chromatography, and then recrystallized from n-hexane to obtain 3.53 g of the objective Compound 1. The structure of the compound was confirmed by $^1$NMR and MASS spectra.

Synthesis of Compound 6

93.5 g of α-bromoacetaldehydediethylacetal and 70.8 g of triethylphosphite were reacted at 160° C. for 6 hours. The reaction product was distilled by a vacuum pump to obtain 65.7 g of the objective α-diethyloxyphosphinylacetaldehydediethylacetal. 20.0 g of α-diethyloxyphosphinylacetaldehydediethylacetal was dissolved in acetone and hydrochloric acid, heated under reflux, hydrolyzed, and post-treated in an ordinary method to obtain 13.6 g of acetaldehyde as an oily product. 17.9 g of 2,4-dimethylphenol and 10 ml of acetic acid were mixed to the above-obtained product, and 2 ml of concentrated sulfuric acid was dropwise added thereto. After stirring for 2 hours, methanol and water were added to the reaction product, recovered, and dried to obtain 17.6 g of the objective Compound 6. The structure of the compound was confirmed by $^1$NMR and MASS spectra.

The compounds of the present invention are preferably used in an amount of 0.0002 to 20 g, more preferably 0.001 to 5 g, per m$^2$ of the photographic material.

The compounds of the present invention can be incorporated into the photographic material using various known dispersion methods, and an oil-in-water dispersion method is preferred, which comprises dissolving a compound in a high boiling point organic solvent (a low boiling point organic solvent may be used in combination, if necessary), dispersing the dissolved compound into an aqueous gelatin solution in the form of an emulsion, and incorporating the dispersion into a silver halide emulsion.

Examples of high boiling point solvents which can be used in the oil-in-water dispersion method are described, for example, in U.S. Pat. No. 2,322,027. Further, specific examples of the processes and effects of the latex dispersion method, which is one of the polymer dispersion methods, and examples of latexes for impregnation are disclosed, for example, in U.S. Pat. No. 4,199,363, West German Patent Application (OLS) Nos. 2,541, 274 and 2,541,230, JP-B-53-41091 (the term "JP-B" as used herein refers to an "examined Japanese patent publication), and European Patent Publication 29,104, and the dispersion method using an organic solvent-soluble polymer is disclosed in WO 88/00723.

Examples of high boiling point organic solvents which can be used in the above-described oil-in-water dispersion method include phthalic acid esters (for example, dibutyl phthalate, dioctyl phthalate, dicyclohexyl phthalate, di-2-ethylhexyl phthalate, decyl phthalate, bis(2,4-di-tert-amylphenyl) isophthalate, and bis(1,1-diethylpropyl) phthalate), phosphoric acid or phosphonic acid esters (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl-p-hydroxy benzoate), amides (for example, N,N-diethyldodecanamide and N,N-diethyllaurylamide), alcohols or phenols (for example, isostearyl alcohol and 2,4-di-tert-amylphenol), alkyl esters (for example, dibutoxyethyl succinate, di-2-ethylhexyl succinate, 2-hexyldecyl tetradecanoate, and tributyl citrate), aniline derivatives (for example, N,N-dibutyl-2-butoxy-5-tert-octylaniline), chlorinated paraffins (for example, a parrafin having a chlorine content of from 10% to 80%), trimesic acid esters (for example, tributyl trimesate), dodecylbenzene, diisopropylnaphthalene, phenols (for example, 2,4-di-tert-amylphenol, 4-dodecyloxyphenol, 4-dodecyloxycarbonylphenol, and 4-(4-dodecyloxyphenylsulfonyl)phenol), carboxylic acids (for example, 2-(2,4-di-tert-amylphenoxy butyrate, 2-ethoxyoctanedecanoic acid), alkyl phosphates (for example, di-2(ethylhexyl)phosphate, diphenyl phosphate), etc. Further, organic solvents having a boiling point of 30° C. or more but about 160° C. or less (for example, ethyl acetate, butyl acetate, ethyl propionate, methyl ethyl ketone, cyclohexanone, 2-ethoxyethyl acetate, and dimethylformamide) may be used in combination, as auxiliary solvents.

A high boiling point organic solvent can be used in a range of from 0 to 10.0 times, preferably from 0 to 5.0 times, more preferably from 0 to 1.0 times, the amount of the compound of the present invention, in a weight ratio.

The compound of the present invention is preferably used in the same layer or the adjacent layer, more preferably in the same layer, as the layer containing a yellow color forming coupler, a magenta color forming coupler, and a cyan color forming coupler, respectively forming yellow, magenta, and cyan colors by coupling reaction with the oxidation product of an aromatic primary amine color developing agent.

These couplers may be 4-equivalent or 2-equivalent to the silver ion, and may be polymers or oligomers. Further, one kind or two or more kinds of couplers may be used in combination.

The couplers which are preferably used in the present invention are described below.

Cyan color forming couplers for use in the present invention include phenolic type and naphtholic type couplers, and preferred examples are disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent Laid-Open 3,329,729, EP 121,365A, 249,453A, 333,185A2, U.S. Pat. Nos. 3,446,622, 4,333,999, 4,775,616, 4,451,559, 4,427,767, 4,690,889, 4,254,212, 4,296,199, and JP-A-61-42653 (the term "JP-A" as used herein refers to a "published unexamined Japanese patent application"). Further, azole type couplers disclosed in JP-A-64-553, JP-A-64-554, JP-A-64-555, JP-A-64-556, European Patent Publications 488,248, 491,197, 484,900, and 456,226, imidazole type couplers disclosed in U.S. Pat. No. 4,818,672 and JP-A-2-33144, and cyclic active methylene type cyan couplers disclosed in JP-A-64-32260 may also be used.

Particularly preferred cyan color forming couplers are couplers represented by formulae (C-I) and (C-II) described on page 17, the left lower column to page 20, the left lower column of JP-A-2-139544, and couplers disclosed in European Patent Publications 488,248, 491,197, 484,909, and 456,226.

Magenta color forming couplers for use in the present invention preferably include 5-pyrazolone type and pyrazoloazole type couplers, and more preferred examples are disclosed in U.S. Pat. Nos. 4,310,619, 4,351,897, EP 73,636, U.S. Pat. Nos. 3,061,432, 3,725,067, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO 88/04795.

Particularly preferred magenta color forming couplers are pyrazoloazole type magenta color forming couplers represented by formula (I) described on page 3, the right lower column to page 10, the right lower column of JP-A-2-139544, and 5-pyrazolone type magenta color forming couplers represented by formula (M-1) described on page 17, the left lower column to page 21, the left upper column of JP-A-2-139544. The most preferred are the above described pyrazoloazole type magenta color forming couplers.

Yellow color forming couplers for use in the present invention include those disclosed, for example, in U.S. Pat. Nos. 3,933,501, 4,022,620, 4,326,024, 4,401,752, 4,248,961, 5,118,599, 3,973,968, 4,314,023, 4,511,649, 5,118,599, EP 249,473A, JP-A-63-23145, JP-A-63-123047, JP-A-1-250944, JP-A-1-213648, JP-B-58-10739, British Patents 1,425,020 and 1,476,760.

Compounds of the present invention are particularly effective when used in co-emulsifying with yellow color forming couplers, and in this case, preferred yellow color forming couplers are couplers represented by the following formula (YC).

(YC)

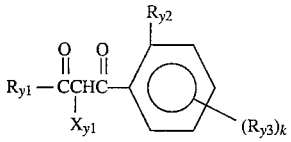

wherein $R_{y1}$ represents an alkyl group, a substituted amino group, or a heterocyclic group; $R_{y2}$ represents a halogen atom, an alkoxy group, or an aryloxy group; $R_{y3}$ represents a group which can be substituted with a benzene ring; $X_{y1}$ represents a hydrogen atom, or a group capable of splitting off upon coupling reaction with the oxidation product of an aromatic primary amine developing agent (hereinafter referred to as "a splitting group"); k represents an integer of from 1 to 4, and when k is 2 or more, a plurality of $R_{y3}$ may be the same or different. Examples of the yellow color forming couplers represented by formula (YC) include (Y-1) to (Y-7) described below.

Examples of particularly preferred yellow color forming couplers include yellow color forming couplers represented by formula (Y) described on page 18, the left upper column to page 22, the left lower column of JP-A-2-139544, acyl acetamide type yellow color forming couplers having characteristics in the acyl group described in European Patent Publication 0447969 and JP-A-5-2248, and yellow color forming couplers represented by formula (Cp-2) of European Patent Publication 0446863A2 and JP-A-5-27389. When compounds represented by formula (I) are used in co-emulsifying with yellow color forming couplers, use of polymers of acrylic acid amide or methacrylic acid amide monomers in co-emulsification is also effective in the present invention.

Couplers which release photographically useful residual groups upon coupling can also be used in the present invention. Preferred examples of DIR couplers which release development restrainers are disclosed in *Research Disclosure*, No. 17643, Item VII-F, JP-A-57-151944, JP-A-57-154234, JP-A-60-184248, JP-A-63-37346, U.S. Pat. Nos.4,248,962, and 4,782,012.

Couplers which release nucleating agents or development accelerators in the form of the image during development are also preferred, and examples are disclosed in British Patents 2,097,140, 2,131,188, JP-A-59-157638, and JP-A-59-170840.

Other couplers which can be used in the present invention include competitive couplers disclosed in U.S. Pat. No. 4,130,427, multiequivalent couplers disclosed in U.S. Pat. Nos. 4,283,472, 4,338,393 and 4,310,618, DIR redox compound releasing couplers, DIR coupler releasing couplers, DIR coupler releasing redox compounds and DIR redox releasing redox compounds disclosed in JP-A-60-185950 and JP-A-62-24252, couplers which release dyes the color of which is restored after being released disclosed in EP 173,302A, bleach accelerator releasing couplers disclosed in *RD*, No. 11449, ibid., No. 24241, and JP-A-61-201247, ligand releasing couplers disclosed in U.S. Pat. No. 4,553,477, leuco dye releasing couplers disclosed in JP-A-63-75747, and fluorescent dye releasing couplers disclosed in U.S. Pat. No. 4,774,181.

Representative couplers for use in the present invention is described below.

(C-1)
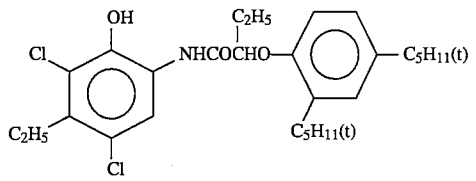
(C-2)
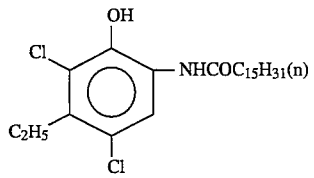
(C-3)
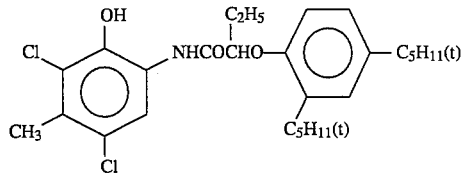
(C-4)
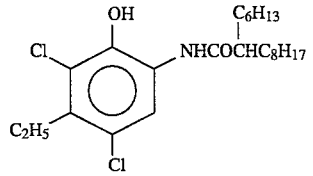
(C-5)
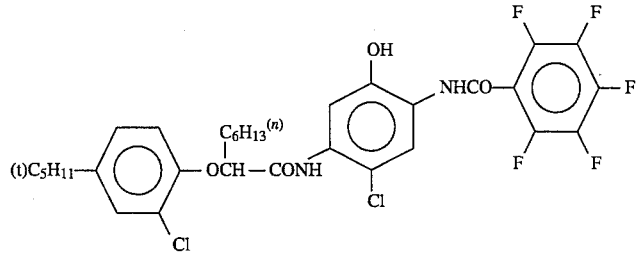
(C-6)
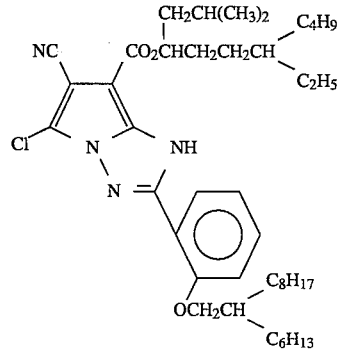

-continued
(C-7)
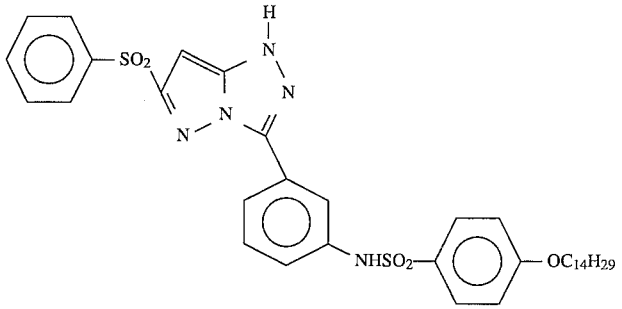
(C-8)
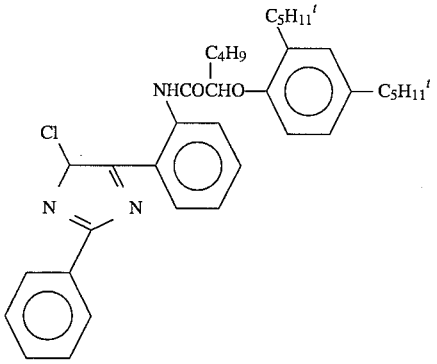
(C-9)
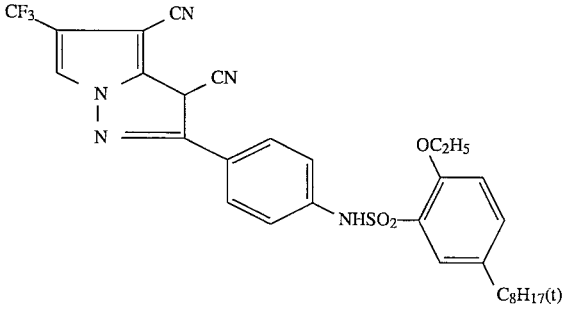
(C-10)
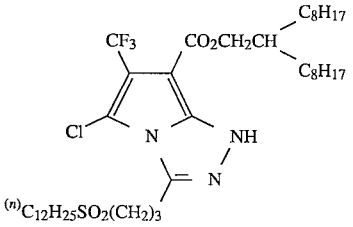
(C-11)
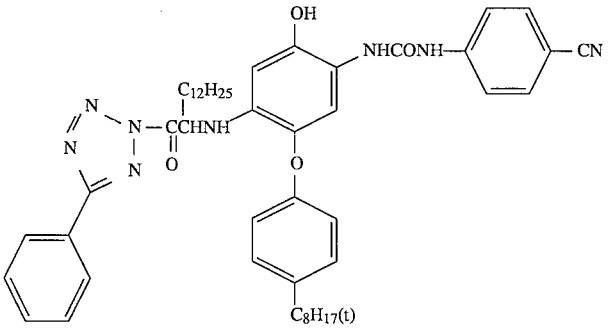

-continued
(C-12)
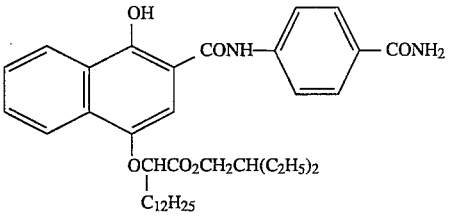
(C-13)
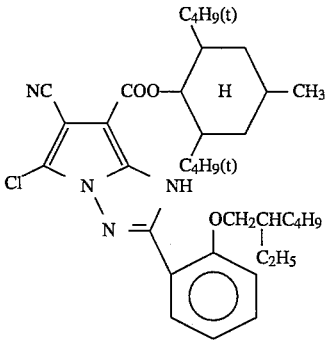
(M-1)
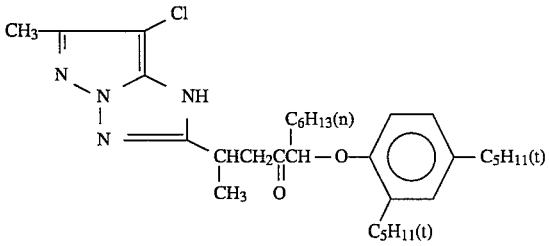
(M-2)
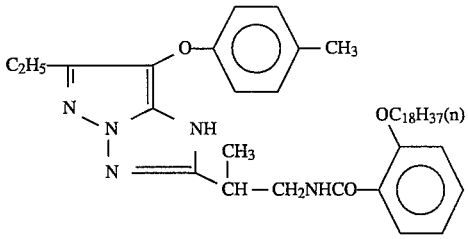
(M-3)
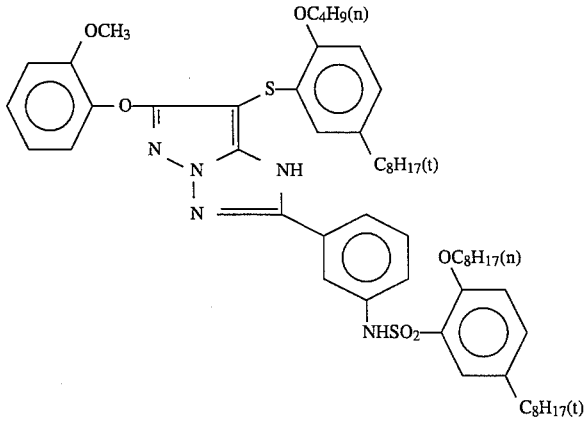

-continued
(M-4)
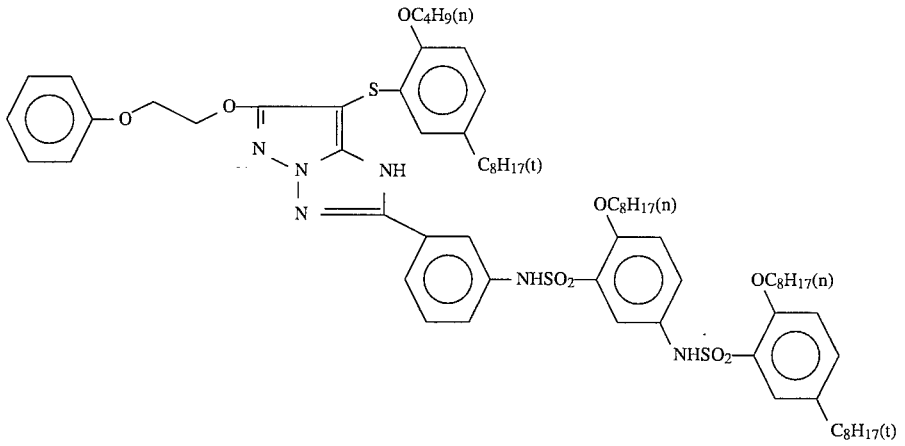
(M-5)
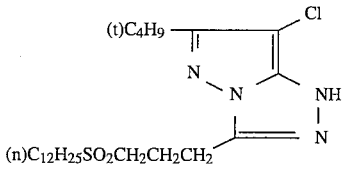
(M-6)
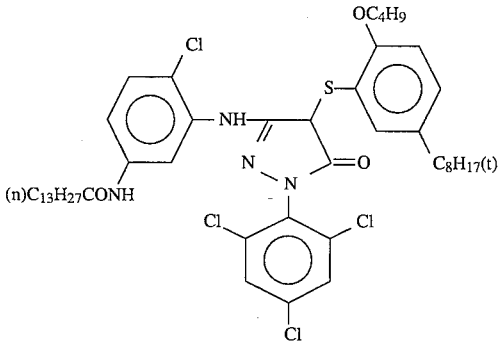
(M-7)
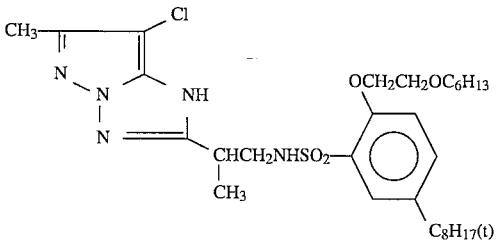
(M-8)
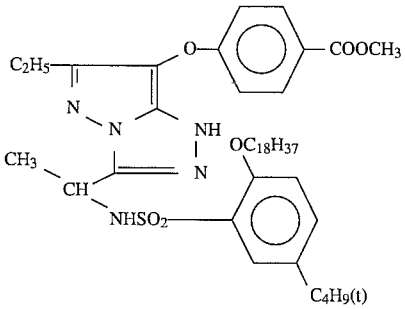

-continued
(M-9)
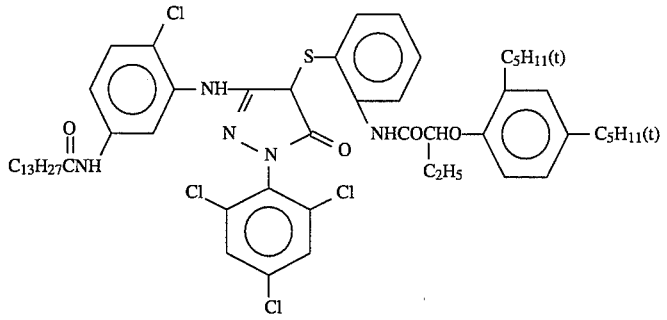
(M-10)
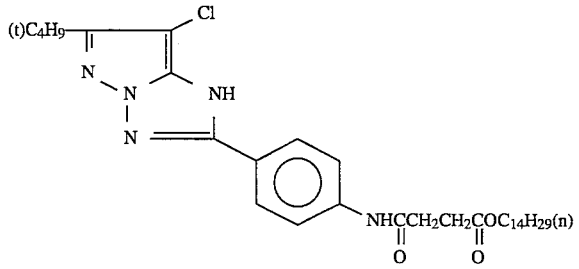
(Y-1)
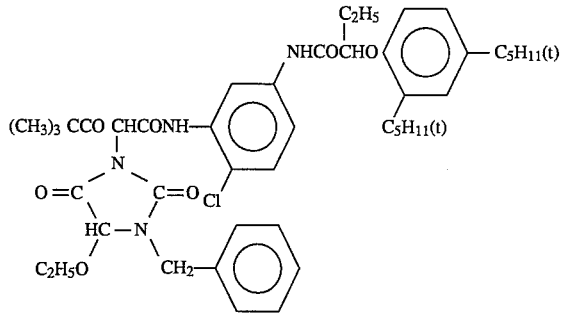
(Y-2)
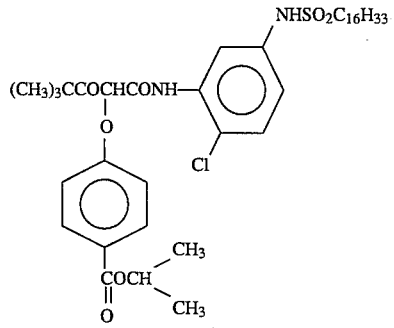
(Y-3)
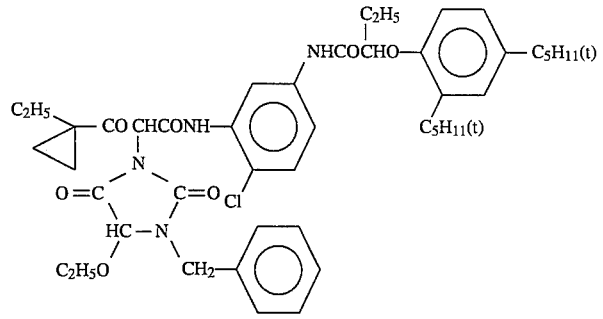

-continued (Y-4)

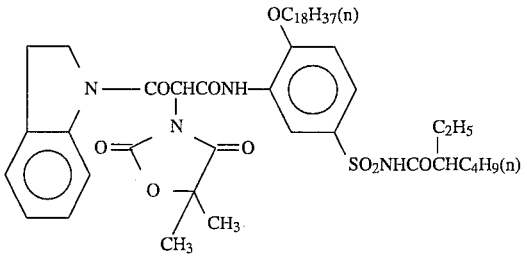

(Y-5)

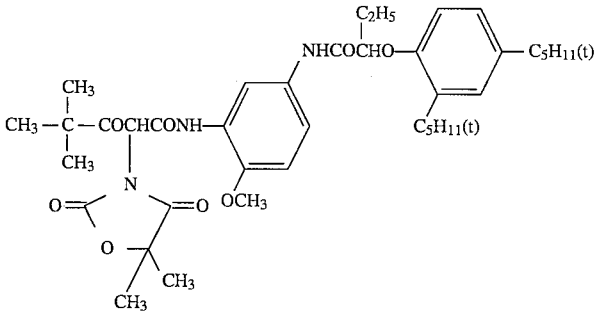

(Y-6)

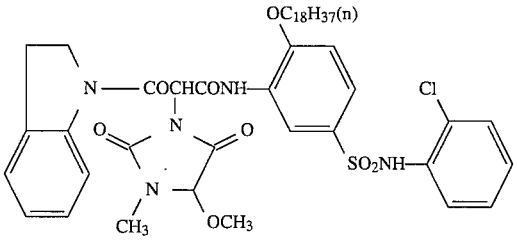

(Y-7)

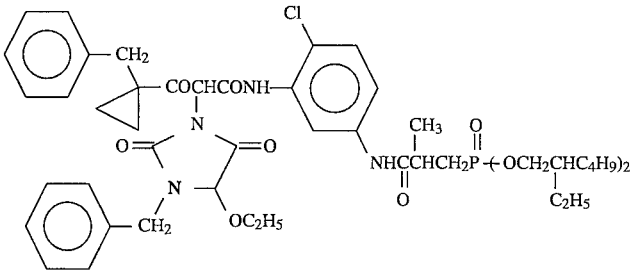

Standard amount used of these color couplers is from 0.001 to 1 mol per mol of the light-sensitive silver halide in the same layer, and preferably from 0.01 to 0.5 mol in a yellow color forming coupler, from 0.003 to 0.3 mol in a magenta color forming coupler, and from 0.002 to 0.3 mol in a cyan color forming coupler.

The standard amount used of the compound of the present invention is as described above, but the amount per a coupler varies depending on the kind and the amount of a couple, and is generally in the range of from 0.5 to 300 mol %, preferably from 1 to 200 mol %, most preferably from 2 to 100 mol %, per mol of the coupler used in the same layer.

Various kinds of known discoloration inhibitors can be used in the photographic material of the present invention as long as they do not hinder the effect of the present invention. Typical examples of organic discoloration inhibitors suitable for cyan, magenta and/or yellow images include hindered phenols represented by hydroquinones, 6-hydroxychromans, 5-hydroxychromans, spirochromans, p-alkoxyphenols, and bisphenols; gallic acid derivatives; methylenedioxybenzenes; aminophenols; hindered amines; and ethers and ester derivatives obtained by silylating or alkylating the phenolic hydroxyl groups contained in each of these compounds. Further, metal complexes represented by (bissalicylaldoximato)nickel complex and (bis-N,N-dialkyldithiocarbamato)nickel complex can also be used.

Specific examples of organic discoloration inhibitors are disclosed in the following patent specifications, that is, hydroquinones are described, for example, in U.S. Pat. Nos. 2,360,290, 2,418,613, 2,700,453, 2,701,197, 2,728,659, 2,732,300, 2,735,765, 3,982,944, 4,430,425, British Patent 1,363,921, U.S. Pat. Nos. 2,710,801, and 2,816,028; 6-hydroxychromans, 5-hydroxychromans, spirochromans in U.S. Pat. Nos. 3,432,300, 3,573,050, 3,574,627, 3,698,909, 3,764,337, and JP-A-52-152225; spiroindanes in U.S. Pat. No. 4,360,589; p-alkoxyphenols in U.S. Pat. No. 2,735,765, British Patent 2,066,975, JP-A-59-10539, and JP-B-57-19765; hindered phenols in U.S. Pat. Nos. 3,700,455, 4,228,235, JP-A-52-72224, and JP-B-52-6623; gallic acid derivatives in U.S. Pat. No. 3,457,079; methylenedioxybenzenes in U.S. Pat. No. 4,332,886; aminophenols in JP-B-56-21144; hindered amines in U.S. Pat. Nos. 3,336,135, 4,268,593, British Patents 1,326,889, 1,354,313, 1,410,846, JP-B-51-1420, JP-A-58-114036, JP-A-59-53846, and JP-A-59-

78344; and metal complexes in U.S. Pat. Nos. 4,050,938, 4,241,155, and British Patent 2,027,731A. These compounds are generally used in an amount of from 5 to 100 wt % to the corresponding couplers, respectively, and co-emulsified therewith, followed by incorporation into the light-sensitive layers to attain the desired object.

When the compound of the present invention and yellow color forming couplers are used in the same layer, amide polymers of acrylic acid amide or methacrylic acid amide monomers can preferably be used in combination therewith to improve discoloration inhibition effect.

The photographic material prepared according to the present invention may contain hydroquinone derivatives, aminophenol derivatives, gallic acid derivatives, ascorbic acid derivatives, etc., as color fog inhibitors. Introduction of UV absorbing agents into a cyan color forming layer and both layers adjacent thereto is more effective to prevent deterioration of cyan color images due to heat and, in particular, light. Further, introduction to the farthest layer from the support, a yellow coupler-containing layer, or an interlayer is also be effective.

Examples of UV absorbing agents which can be used in the present invention include aryl-substituted benzotriazole compounds (e.g., those disclosed in U.S. Pat. No. 3,533,794), 4-thiazolidone compounds (e.g., those disclosed in U.S. Pat. Nos. 3,314,794 and 3,352,681), benzophenone compounds (e.g., those disclosed in JP-A-46-2784 and European Patent Publication 521823), cinnamic acid ester compounds (e.g., those disclosed in U.S. Pat. Nos. 3,705,805 and 3,707,395), butadiene compounds (e.g., those disclosed in U.S. Pat. No. 4,045,229), triazine compounds (e.g., those disclosed in JP-A-46-3335 and European Patent Publication 520938), and benzoxazole compounds (e.g., those disclosed in U.S. Pat. Nos. 3,406,070 and 4,271,307). UV absorbing couplers (e.g., α-naphthol type cyan color forming couplers) and UV absorbing polymers may also be used. These UV absorbing agents may be mordanted to a particular layer. The foregoing aryl-substituted benzotriazole compounds and triazine compounds are preferred of them.

It is preferred to use such compounds for improving the color image storage stability as disclosed in EP Publication 0,277,589A2 together with the couplers in the photographic material of the present invention. In particular, use in combination with an azole type magenta color forming coupler or a cyan color forming coupler is preferred.

That is, compound (A) which produces a chemically inert and substantially colorless compound by chemical bonding with an aromatic amine developing agent remaining after color development processing which is disclosed in European Patent Publication 0,277,589A2 and/or compound (B) which produces a chemically inert and substantially colorless compound by chemical bonding with an oxidation product of the aromatic amine color developing agent remaining after color development processing which is disclosed in European Patent Publication 0,277,589A2 are used in combination or individually to effectively prevent generation of stains during storage after processing which is due to formation of a dye by the reaction of a coupler with a color developing agent or its oxidation product remaining in the film, and to prevent other side reactions.

It is preferred for the photographic material prepared according to the present invention to contain bactericides as disclosed in JP-A-63-271247 to prevent propagation of various bacteria and mold in a hydrophilic colloid layer which deteriorate color images.

The silver halide for use in the present invention includes silver chloride, silver bromide, silver chlorobromide, silver iodochlorobromide and silver iodobromide. However, silver chlorobromide having a silver chloride content of 90 mol % or more, preferably 95% mol % or more, and more preferably 98 mol % or more, and substantially not containing silver iodide is preferably used for the purpose of rapid processing.

Further, it is preferred for the hydrophilic colloid layer of the photographic material of the present invention to contain a dye capable of decoloring by processing (especially oxonol dyes), disclosed in European Patent Publication 0,337,490A2, pp. 27 to 76, so as to make the optical reflection density of the photographic material at 680 run become 0.70 or more, or for the water resistant resin layer of the support to contain 12 wt % or more (more preferably 14 wt % or more) of a titanium oxide surface treated with divalent to tetravalent alcohols (for example, trimethylol ethane or the like), for the purpose of improving sharpness of images.

In addition, a white polyester type support, or a support having a layer containing a white pigment provided on the same side as a silver halide emulsion layer side of the support may be used in the photographic material of the present invention for a display. Further, it is preferred to provide an antihalation layer on the same side as the silver halide emulsion layer side of the support or on the back surface thereof for improving sharpness. The transmission density of the support is preferably set in the range of from 0.35 to 0.8 so as to enjoy a display in either of reflected light or transmitted light.

The photographic material of the present invention may be exposed by either visible light or infrared light. An exposure may be either of a low intensity exposure or a high intensity short time exposure, and in the latter case, a laser scanning exposure the exposure time per one picture element of which is shorter than $10^{-4}$ sec. is preferred. Moreover, it is preferred to use a band and a stop filter disclosed in U.S. Pat. No. 4,880,726, by which the color stain by light is prevented and the color reproduction is extremely improved.

The present invention is preferably applied to photographic materials in which a color developing agent (p-phenylenediamine derivative) does not exist before development processing, for example, the present invention can be applied to color paper, color reversal paper, direct positive color photographic materials, color negative films, color positive films, and color reversal films. Application to color photographic materials having a reflecting support (e.g., color paper and color reversal paper) and color photographic materials forming positive images (e.g., direct positive color photographic material, color positive films, and color reversal films) is preferred, and application to color photographic materials having a reflecting support is particularly preferred.

Photographic materials of the present invention can be development processed according to the ordinary methods disclosed in the above described *RD*, No. 17643, pages 28 and 29, and ibid., No. 18716, page 615, from the left column to the right column. For example, a color development processing step, a desilvering processing step, and a water washing processing step are carried out. In the desilvering processing step, a bleach-fixing processing step using a bleach-fixing solution can be carried out instead of a bleaching step using a bleaching solution and a fixing step using a fixing solution. These bleach processing step, fixing processing step, and bleach-fixing step may be combined arbitrarily. A stabilization step may be conducted instead of a washing processing step, or a stabilization step may be conducted after a washing processing step. In addition, a monobath processing step in which color development, bleaching and fixing are carried out in one bath using a monobath development-bleach-fixing solution can be conducted. Further, in combination with these steps, a pre-hardening processing step, a neutralizing step, a stop-fixing processing step, a post-hardening processing step, an adjustment step, and an intensifying step may be conducted. Arbitrary intermediate washing steps may be carried out between above steps. A so-called activator processing step may be conducted in place of the color development processing step in these processing steps.

Preferred examples of silver halide emulsions and other substances (additives or the like) for use in the present invention, photographic constitutional layers (arrangement of the layers or the like), and processing methods for processing the photographic materials and additives for processing are disclosed in JP-A-4-359249 and the patent publications described below, and those disclosed in European Patent Publication 0,355,660A2 are preferably used.

TABLE 1

| Photographic Constitutional Element | JP-A-62-215272 | JP-A-2-33144 | EP 0,355,660A2 |
|---|---|---|---|
| Silver Halide Emulsion | p. 10, right upper column, l 6 to p. 12, left lower column, l. 5<br>p. 12, right lower column, 4 line up from the bottom to p. 13, left upper column, l. 17 | p. 28, right upper column, l. 16 to p. 29, right lower column, l. 11<br>p. 30, ll. 2 to 5 | p. 45, l 53 to p. 47, l. 3<br>p. 47, ll. 20 to 22 |
| Silver Halide Solvent | p. 12, left left upper column, ll. 6 to 14<br>p. 13, left upper column, 3 line up from the bottom to p. 18, left lower column, last line | — | — |
| Chemical Sensitizer | p. 12, left lower column, 3 line up from the bottom to right lower column, 5 line up from the bottom<br>p. 18, right lower column, l. 1 to p. 22, right upper column, 9 line up from the bottom | p. 29, right lower column, l. 12 to last line | p. 47, ll. 4 to 9 |
| Spectral Sensitizer (spectral sensitizing method) | p. 22, right upper column, 8 line up from the bottom to p. 38, last line | p. 30, left upper column, ll. 1 to 13 | p. 47, ll. 10 to 15 |
| Emulsion Stabilizer | p. 39, left upper column, l. 1 to p. 72, right upper column, last line | p. 30, left upper column, l. 14 to right upper column, l. 1 | p. 47, ll. 10 to 15 |
| Development Accelerator | p. 72, left lower column, l. 1 to p. 91, right upper column, l. 3 | — | — |
| Color Coupler (cyan, magenta, yellow) | p. 91, right upper column, l. 4 to p. 121, left upper column, l. 6 | p. 3, right upper column, l. 14 to p. 18, left upper column, last line<br>p. 30, right upper column, l. 6 to p. 35, right lower column, l. 11 | p. 4, ll. 15 to 27<br>p. 5, l. 30 to p. 28, last line<br>p. 45, ll. 29 to 31<br>p. 47, l. 23 to p. 63 l. 50 |
| Supersensitizer | p. 121, left upper column, l. 7 to p. 125, right upper column, l. 1 | — | — |
| UV Absorbing Agent | p. 125, right upper column, l. 2 to p. 127, left lower column, last line | p. 37, right lower column, l. 14 to p. 38, left upper column, l. 11 | p. 65, pp. 22 to 31 |
| Discoloration Inhibitor (image stabilizing method) | p. 127, right lower column, l. 1 to p. 137, left lower column, l. 8 | p. 36, right upper column, l. 12 to p. 37, left upper column, l. 19 | p. 4, l. 30 to p. 5, l. 23<br>p. 29, l. 1 to p. 45, l. 25<br>p. 45, ll. 33 to 40<br>p. 65, ll. 2 to 21 |
| High Boiling Point and/or Low Boiling Point Organic Solvent | p. 137, left lower column, l. 9 to p. 144, right upper column, last line | p. 35, right lower column, l. 14 to p. 36, left upper column, 4 line up from the bottom | p. 64, ll. 1 to 51 |
| Dispersing Method of Photographic Additives | p. 144, left lower column, l. 1 to p. 146, right upper column, l. 7 | p. 27, right lower column, l. 10 to p. 28, left upper column, last line<br>p. 35, right lower column, l. 12 to p. 36, right upper column, l. 7 | p. 63, l. 51 to p. 64, l. 56 |

TABLE 1-continued

| Photographic Constitutional Element | JP-A-62-215272 | JP-A-2-33144 | EP 0,355,660A2 |
|---|---|---|---|
| Hardening Agent | p. 146, right upper column, l. 8 to p. 155, left lower column, l. 4 | — | — |
| Developing Agent Precursor | p. 155, left lower column, p. 5 to p. 155, right lower column, l. 2 | — | — |
| DIR Compound | p. 155, right lower column, ll. 3 to 9 | — | — |
| Support | p. 155, right lower column, l. 19 to p. 156, left upper column, l. 14 | p. 38, right upper column, l. 18, to p. 39, left upper column. l. 3 | p. 66, l. 29 to p. 67, l. 13 |
| Composition of Light-Sensitive Layer | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right lower column, last line | p. 38, left upper column, l. 12 to right upper column, l. 7 | p. 66, ll. 18 to 22 |
| Emulsion Stabilizer | p. 39, left upper column, l. 1 to p. 72, right upper column, last line | p. 30, left upper column, l. 14 to right upper column, l. 1 | p. 47, ll. 10 to 15 |
| Color Mixture Inhibitor | p. 185, left upper column, l. 1 to p. 188, right lower column, l. 3 | p. 36, right upper column, ll. 8 to 11 | p. 64, l. 57 to p. 65, l. 1 |
| Gradation Controlling Agent | p. 188, right lower column, ll. 4 to 8 | — | — |
| Stain Inhibitor | p. 188, right lower column, l. 9 to p. 193, right lower column, l. 10 | p. 37, left upper column, last line to right lower column, l. 13 | p. 65, l. 32 to p. 66, l. 17 |
| Surfactant | p. 201, left lower column, l. 1 to p. 210, right upper column, last line | p. 18, right upper column, l. 1 to p. 24, right lower column, last line<br>p. 27, left lower column, 10 line up from the bottom to right lower column, l. 9 | — |
| Fluorine-Containing Compound (as anti-static agent, coating aid, lubricant, adhesion preventive agent) | p. 210, left lower column, l. 1 to p. 222, left lower column, l. 5 | p. 25, left upper column, l. 1 to p. 27, right lower column, l. 9 | — |
| Binder (hydrophilic colloid) | p. 222, left lower column, l. 6 to p. 225, left upper column, last line | p. 38, right upper column, ll. 8 to 18 | p. 66, ll. 23 to 28 |
| Tackifier | p. 225, right upper column, l. 1 to p. 227, right upper column, l. 2 | — | — |
| Antistatic Agent | p. 227, right upper column, l. 3 to p. 230, left upper column, l. 1 | — | — |
| Polymer Latex | p. 230, left upper column, l. 2 to p. 239, last line | — | — |
| Matting Agent | p. 240, left upper column, l. 1 to p. 240, right upper column, last line | — | — |
| Photographic Processing Method (processing step or additives) | p. 3, right upper column, l. 7 to p. 10, right upper column, l. 5 | p. 39, left upper column, l. 4 to p. 42, left upper column, last line | p. 67, l. 14 to p. 69, l. 28 |

Note) References in column JP-A-62-215272 include contents amended by The Amendment dated March 16, 1987, which appears at the end of the Patent Publication.
Of couplers described above, so-called short wave type yellow couplers disclosed in JP-A-63-231451, JP-A-63-123047, JP-A-63-241547, JP-A-1-173499, JP-A-1-213648 and JP-A-1-250944 are preferably used as yellow couplers.

EXAMPLES

The present invention is described in detail with reference to the examples, but it should not be construed as being limited thereto.

EXAMPLE 1

A single-layer light-sensitive material Sample 001 for evaluation of the layer composition as shown below was prepared using an undercoated triacetyl cellulose support.

Preparation of Coating Solution for Emulsion Layer 1.85 mmol of a coupler was added to and dissolved in a 10 cc of ethyl acetate and 50 wt % based on the coupler, respectively, of trioctyl phosphate and tricresyl phosphate (solvents). This solution was dispersed in an emulsified condition into 33 g of a 14% aqueous gelatin solution containing 3 cc of a 10% solution of sodium dodecylbenzenesulfonate. On the other hand, two kinds of silver chlorobromide emulsions were prepared (cubic form, a mixture in a ratio of 3:7 (silver mol ratio) of a large grain size emulsion having an average grain size of 0.88 μm, and a small grain size emulsion having an average grain size of 0.70 μm; variation coefficients of the grain size distribution are 0.08 and 0.10, respectively, both of them contained 0.3 mol % of silver bromide localized at a part of the grain surface). The blue-sensitive Sensitizing Dyes A and B shown below were added in an amount of $2.0\times10^{-4}$ mol to the large grain size emulsion and $2.5\times10^{-4}$ mol to the small grain size emulsion. Chemical ripening was conducted by addition of a sulfur sensitizer and a gold sensitizer. This emulsion was mixed with the foregoing emulsified dispersion and dissolved to obtain a coating solution for the emulsion layer. 1-Oxo-3,5-dichloro-s-triazine sodium salt was used as a hardening agent.

Sensitizing Dye A

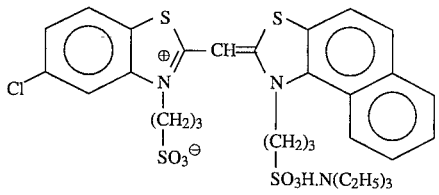

Sensitizing Dye B

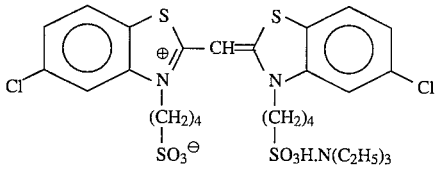

Layer Composition

The compositions of the layers of the sample used in this experiment are described below. (The numeral represents the coating amount per $m^2$.)

Support

Triacetyl Cellulose Support

| Emulsion Layer | |
|---|---|
| Silver Chlorobromide (described above) | 3.0 mmol |
| Coupler (Y-3) | 1.0 mmol |
| Solvent (trioctyl phosphate and tricresyl phosphate (1:1) | (coating weight is the same as the coating weight of the coupler) |
| Gelatin | 5.5 g |
| **Protective Layer** | |
| Gelatin | 1.5 g |
| Copolymer of Acryl-Modified Polyvinyl Alcohol (modification degree: 17%) | 0.15 g |
| Liquid Paraffin | 0.03 g |

Samples 002 to 011 were prepared in the same manner as Sample 001 except that comparative discoloration inhibitors (A, B, C) or Compound 1 of the present invention were added in the amount indicated in Table A (mol % per coupler) in oil droplet.

Samples 001 to 011 were imagewise exposed through an optical wedge. After exposure, samples were subjected to a processing of the following steps.

| Processing Step | Temperature (°C.) | Time (sec) |
|---|---|---|
| Color Development | 35 | 45 |
| Bleach-Fixing | 35 | 45 |
| Washing | 35 | 60 |
| Drying | 80 | 60 |

The composition of each processing solution is described below.

| Color Developing Solution | |
|---|---|
| Water | 800 ml |
| 1-Hydroxyethylidene-1,1-diphosphonic Acid (60 wt %) | 0.8 ml |
| Lithium Sulfate (anhydrous) | 2.7 g |
| Triethanolamine | 8.0 g |
| Sodium Chloride | 1.4 g |
| Potassium Bromide | 0.03 g |
| Diethylhydroxylamine | 4.6 g |
| Potassium Carbonate | 27 g |
| Sodium Sulfite | 0.1 g |
| N-Ethyl-N-(β-methanesulfonamido-ethyl)-3-methyl-4-aminoaniline-3/2 Sulfate·Monohydrate | 4.5 g |
| Brightening Agent (4,4'-diamino-stilbene type) | 2.0 g |
| Water to make | 1,000 ml |
| pH (adjusted with potassium hydroxide and sulfuric acid) | 10.25 |
| **Bleach-Fixing Solution** | |
| Water | 400 ml |
| Ammonium Thiosulfate (700 g/liter) | 100 ml |
| Sodium Sulfite | 17 g |
| Ammonium Ethylenediaminetetraacetato Ferrate | 55 g |
| Disodium Ethylenediaminetetraacetate | 5 g |
| Glacial Acetic Acid | 9 g |
| Water to make | 1,000 ml |
| pH (25° C.) (adjusted with acetic acid and ammonia water) | 5.40 |

The processed samples were examined visually and the hue was evaluated.

The color densities of the above samples were then measured by blue light (center wavelength: 440 nm) and maximum color densities (Dmax) were determined. Further, the samples were irradiated for one month using 20,000 lux fluorescent lamp discoloration tester, and color densities after discoloration were determined. A color remaining rate as a criterion of the light fastness was calculated from the reduction of the color density from the original density, taking the original density as 1.0.

The results obtained are shown in Table A.

TABLE A

| Sample No. | Coupler | Discoloration Inhibitor | Addition Amount (mol %) | Color Density (Dmax) | Light Fastness (remaining %) | Hue | Remarks |
|---|---|---|---|---|---|---|---|
| 001 | Y-3 | — | — | 1.75 | 70 | o (good) | Comparison |
| 002 | " | Comparative Compound A | 10 | 1.72 | 77 | o (good) | " |
| 003 | " | Comparative Compound A | 25 | 1.66 | 85 | Δ[1)] | " |
| 004 | " | Comparative Compound A | 50 | 1.58 | 88 | x[2)] | " |
| 005 | " | Comparative Compound A | 100 | 1.46 | 90 | xx[3)] | " |
| 006 | " | Compound 1 | 10 | 1.76 | 80 | o (good) | Invention |
| 007 | " | " | 25 | 1.75 | 87 | o (good) | " |
| 008 | " | " | 50 | 1.73 | 92 | o (good) | " |
| 009 | " | " | 100 | 1.71 | 95 | Δ[1)] | " |
| 010 | " | Comparative Compound B | 50 | 1.69 | 78 | o (good) | Comparison |
| 011 | " | Comparative Compound C | 50 | 1.54 | 74 | o (good) | " |

[1)]Turbidity of cyan color was slightly observed compared with Sample 001.
[2)]Turbidity of cyan color was large compared with Sample 001.
[3)]Turbidity of cyan color was very large compared with Sample 001 and the color was greenish brown.

Comparative Compound A

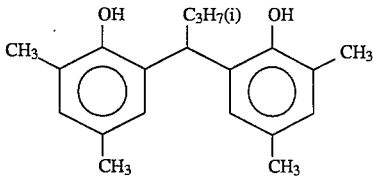

Comparative Compound B

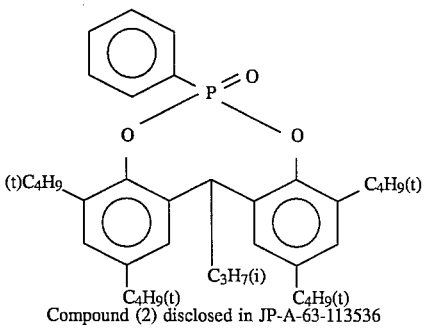

Compound (2) disclosed in JP-A-63-113536

Comparative Compound C

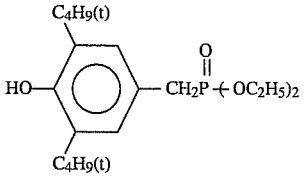

When the addition amount of Comparative Compound A was 25 mol % or more based on the amount of the coupler, the turbidity of cyan color was observed and it showed a tendency to increase as the addition amount increased.

On the contrary, a little turbidity was observed when the addition amount of Compound 1 of the present invention reached 100 mol %. While, the turbidity was not observed even when Compound B was added in an amount of 100 mol % and the hue was rather improved.

With the increase of the addition amount of Comparative Compound A, the light fastness is improved, however, the color density reduces at the same time. The light fastness is improved largely when the addition amount is 25 mol % or more, but the color density decreases leading to degradation of the hue, and this is practically a large problem. On the contrary, when Compound 1 of the present invention is used, reduction of color density is improved greatly and color turbidity is scarcely generated. Further, the effect of discoloration improvement is greater when compared with that of Comparative Compound A under the same addition amount, therefore, it is apparent that the compound of the present invention is a superior discoloration inhibitor.

As is understood from the above, the compound of the present invention can remarkably improve the discoloration due to light without causing the color density reduction and deterioration of the hue.

EXAMPLE 2

A surface of a paper support laminated on both sides with polyethylene was corona discharged. The support was provided with a gelatin subbing layer containing sodium dodecylbenzenesulfonate, and further, various photographic constitutional layers described below were coated to prepare a multilayer color photographic paper (Sample 102). The coating solutions were prepared in the following manner.

Preparation of Coating Solution for First Layer 140.0 g of a yellow coupler (ExY), 70.0 g of a color image stabilizer (Cpd-1), 26.0 g of a color image stabilizer (Cpd-2), 16.0 g of a color image stabilizer (Cpd-3), and 20.0 g of a color image stabilizer (Cpd-5) were dissolved in 26 g of a solvent (Solv-1), 26 g of a solvent (Solv-2), 26.0 g of a solvent (Solv-5) and 280 cc of ethyl acetate, and this solution was dispersed in an emulsified condition into 1,000 g of a 10% aqueous gelatin solution containing 60 cc of 10% sodium dodecylbenzenesulfonate to obtain an emulsified dispersion A. On the other hand, two kinds of silver chlorobromide emulsions A were prepared (cubic form, a mixture in a ratio of 3:7 (silver mol ratio) of a large grain size emulsion A having an average grain size of 0.88 μm, and a small grain size emulsion A having an average grain size of 0.70 μm; variation coefficients of the grain size distribution are 0.08 and 0.10, respectively, both of them contained 0.3 mol % of silver bromide localized at a part of the grain surface of substrate of silver chloride). The blue-sensitive Sensitizing Dyes A, B, and C shown below were added in an amount of $1.4\times10^{-4}$ mol to the large grain size emulsion A and $1.7\times10^{-4}$ mol to the small grain size emulsion A. Chemical ripening was conducted by addition of a sulfur sensitizer and a gold sensitizer. This silver chlorobromide emulsion A was mixed with the foregoing emulsified dispersion A and dissolved to Obtain a coating solution for the first layer having the composition described below. The coating amount of the emulsion is calculated in terms of silver.

The coating solutions for from the second to seventh layers were prepared in the same manner as the coating solution for the first layer. 1-Oxo-3,5-dichloro-s-triazine sodium salt was used as a gelatin hardening agent in each layer.

Further, Cpd-12 and Cpd-13 were added to each layer so that the total coating amount becomes 25.0 mg/m$^2$ and 50.0 mg/m$^2$, respectively.

The spectral sensitizing dyes described below were used in the silver chlorobromide emulsion of each light-sensitive emulsion layer.

Blue-Sensitive Emulsion Layer:

Sensitizing Dye A

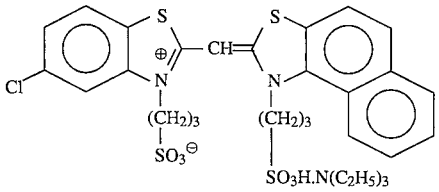

Sensitizing Dye B

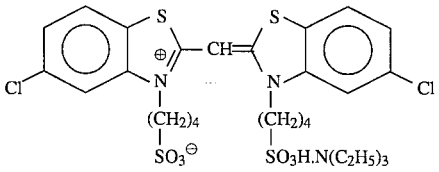

-continued

Sensitizing Dye C

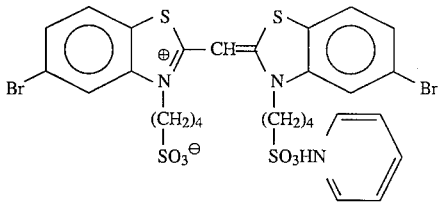

(in an amount of $1.4\times10^{-4}$ mol/mol Ag to the large grain size emulsion, and in an amount of $1.7\times10^{-4}$ mol/mol Ag to the small grain size emulsion)

Green-Sensitive Emulsion Layer:

Sensitizing Dye D

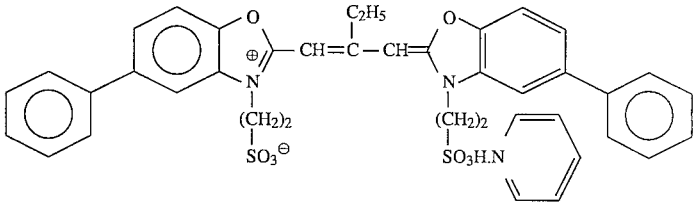

(in an amount of $3.0\times10^{-4}$ mol/mol Ag to the large grain size emulsion, and in an amount of $3.6\times10^{-4}$ mol/mol Ag to the small grain size emulsion)

Sensitizing Dye E

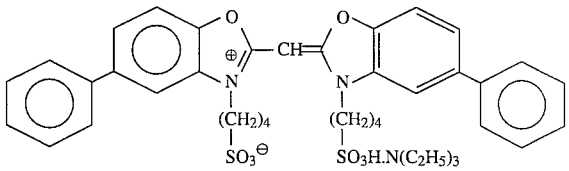

(in an amount of $4.0\times10^{-5}$ mol/mol Ag to the large grain size emulsion, and in an amount of $7.0\times10^{-5}$ mol/mol Ag to the small grain size emulsion)

Sensitizing Dye F

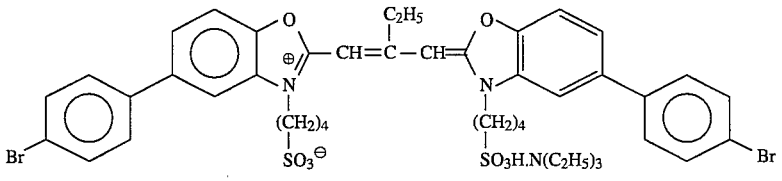

(in an amount of $2.0\times10^{-4}$ mol/mol Ag to the large grain size emulsion, and in an amount of $2.8\times10^{-4}$ mol/mol Ag to the small grain size emulsion)

Red-Sensitive Emulsion Layer:

Sensitizing Dye G

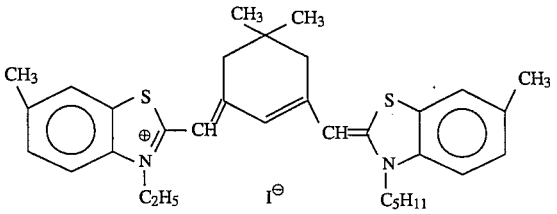

(in an amount of $5.0\times10^{-5}$ mol/mol Ag to the large grain size emulsion, and in an amount of $6.0\times10^{-5}$ mol/mol Ag to the small grain size emulsion)

Sensitizing Dye H

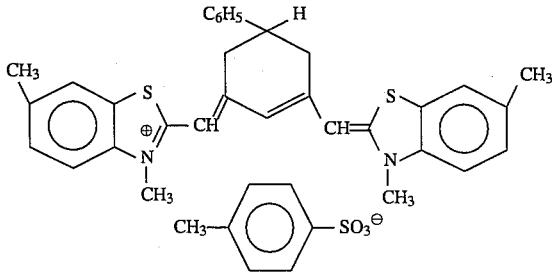

(in an amount of $5.0\times10^{-5}$ mol/mol Ag to the large grain size emulsion, and in an amount of $6.0\times10^{-5}$ mol/mol Ag to the small grain size emulsion)

The following compound was further added to the red-sensitive emulsion layer in an amount of $2.6\times10^{-3}$ mol per mol of silver halide.

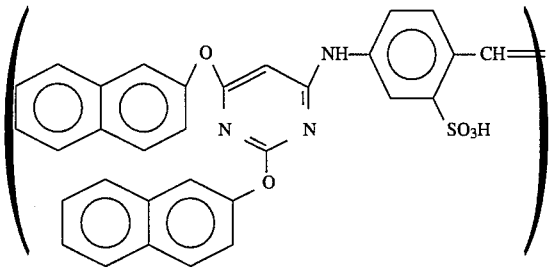

Further, 1-(5-methylureidophenyl)-5-mercaptotetrazole was added to the blue-sensitive emulsion layer, the green-sensitive emulsion layer and the red-sensitive emulsion layer in amounts of $3.5\times10^{-4}$ mol, $3.0\times10^{-3}$ mol and $2.5\times10^{-4}$ mol, respectively, per mol of silver halide.

In addition, 4-hydroxy-6-methyl-1,3,3a, 7-tetraazaindene was added to the blue-sensitive emulsion layer and the green-sensitive emulsion layer in amounts of $1\times10^{-4}$ mol and $2\times10^{-4}$ mol, respectively, per mol of silver halide.

Moreover, the following dyes were added to the emulsion layer for preventing irradiation (the figures in parentheses represent the coating amount).

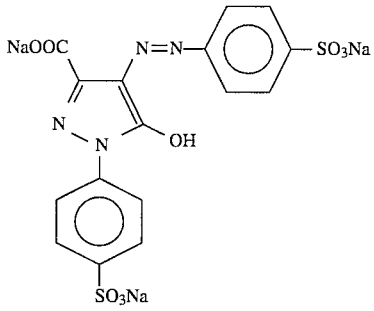

(10 mg/m$^2$)

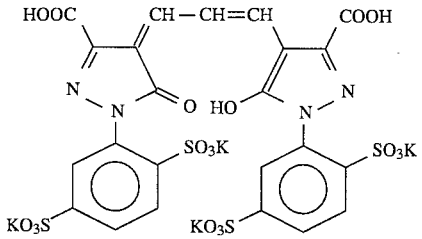

(10 mg/m$^2$)

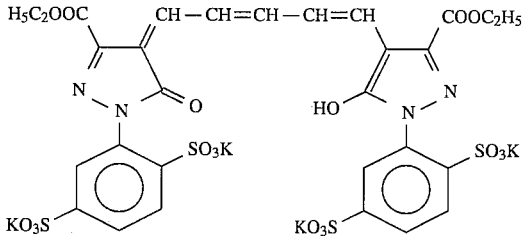

(40 mg/m$^2$)

and

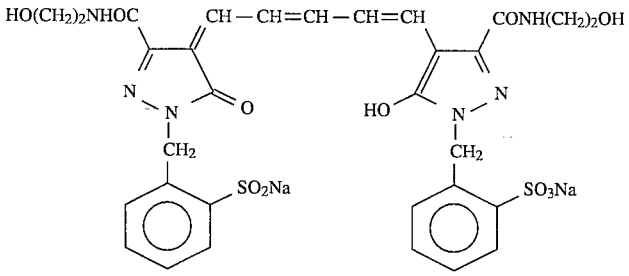

(20 mg/m$^2$)

Layer Composition

The composition of each layer is described below. The figure represents the coating amount g/m$^2$. The figure for the silver halide emulsion represents the coating amount in terms of silver.

Support:

Polyethylene-laminated paper (a white pigment ($TiO_2$, 14 wt %) and a blue dye (ultramarine) were added to the polyethylene of the first layer side).

| | |
|---|---|
| First Layer (blue-sensitive emulsion layer) | |
| Silver Chlorobromide Emulsion A described above | 0.27 |
| Gelatin | 1.50 |
| Yellow Coupler (ExY) | 0.70 |
| Color Image Stabilizer (Cpd-1) | 0.35 |
| Color Image Stabilizer (Cpd-2) | 0.13 |
| Color Image Stabilizer (Cpd-3) | 0.08 |
| Color Image Stabilizer (Cpd-5) | 0.10 |
| Solvent (Solv-1) | 0.13 |
| Solvent (Solv-2) | 0.13 |
| Solvent (Solv-5) | 0.13 |
| Second Layer (color mixture inhibiting layer) | |
| Gelatin | 1.00 |
| Color Mixture Inhibitor (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| Third Layer (green-sensitive emulsion layer) | |
| Silver Chlorobromide Emulsion (cubic form, a mixture in a ratio of 1:3 (Ag mol ratio) of a large grain size emulsion B having an average grain size of 0.55 μm, and a small grain size emulsion B having an average grain size of 0.39 μm; variation coefficients of the grain size distribution are 0.10 and 0.08, respectively, both of them contained 0.8 mol % of AgBr localized at a part of the grain surface of substrate of silver chloride) | 0.13 |
| Gelatin | 1.45 |
| Magenta Coupler (ExM) | 0.16 |
| UV Absorbing Agent (UV-2) | 0.16 |
| Color Image Stabilizer (Cpd-2) | 0.03 |
| Color Image Stabilizer (Cpd-5) | 0.10 |
| Color Image Stabilizer (Cpd-6) | 0.01 |
| Color Image Stabilizer (Cpd-7) | 0.01 |
| Color Image Stabilizer (Cpd-8) | 0.08 |
| Color Image Stabilizer (Cpd-10) | 0.02 |
| Solvent (Solv-3) | 0.13 |
| Solvent (Solv-4) | 0.39 |
| Solvent (Solv-6) | 0.26 |
| Fourth Layer (color mixture inhibiting layer) | |
| Gelatin | 0.70 |
| Color Mixture Inhibitor (Cpd-4) | 0.06 |
| Solvent (Solv-1) | 0.07 |
| Solvent (Solv-2) | 0.11 |
| Solvent (Solv-3) | 0.18 |
| Solvent (Solv-8) | 0.02 |
| Fifth Layer (red-sensitive emulsion layer) | |
| Silver Chlorobromide Emulsion (cubic form, a mixture in a ratio of 1:4 (Ag mol ratio) of a large grain size emulsion C having an average grain size of 0.50 μm, and a small grain size emulsion C having an average grain size of 0.41 μm; variation coefficients of the grain size distribution are 0.09 and 0.11, respectively, both of them contained 0.8 mol % of AgBr localized at a part of the grain surface of substrate of silver chloride) | 0.20 |
| Gelatin | 0.85 |
| Cyan Coupler (ExC) | 0.33 |
| UV Absorbing Agent (UV-2) | 0.18 |
| Color Image Stabilizer (Cpd-1) | 0.33 |
| Color Image Stabilizer (Cpd-6) | 0.01 |
| Color Image Stabilizer (Cpd-8) | 0.01 |
| Color Image Stabilizer (Cpd-9) | 0.02 |
| Color Image Stabilizer (Cpd-10) | 0.01 |
| Solvent (Solv-1) | 0.01 |
| Solvent (Solv-7) | 0.22 |
| Sixth Layer (UV absorbing layer) | |
| Gelatin | 0.60 |
| UV Absorbing Agent (UV-1) | 0.39 |
| Color Image Stabilizer (Cpd-5) | 0.01 |
| Color Image Stabilizer (Cpd-7) | 0.05 |
| Solvent (Solv-9) | 0.05 |
| Seventh Layer (protective layer) | |
| Gelatin | 1.00 |
| Copolymer of Acryl-Modified Polyvinyl Alcohol (modification degree: 17%) | 0.05 |
| Liquid Paraffin | 0.02 |

-continued
Surfactant (Cpd-11) 0.01
(ExY) Yellow Coupler
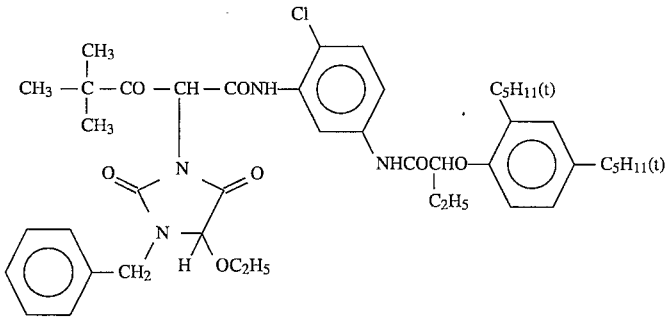
(ExM) Magenta Coupler
1:1 mixture (by mol ratio) of
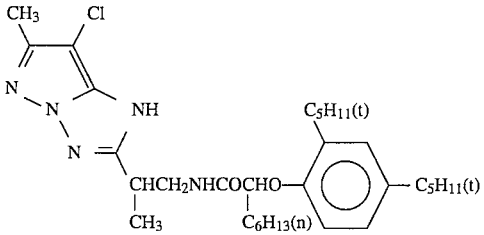
with
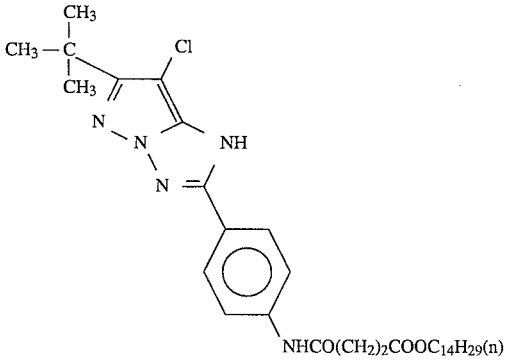
(ExC) Cyan Coupler
25:75 mixture (by mol ratio) of
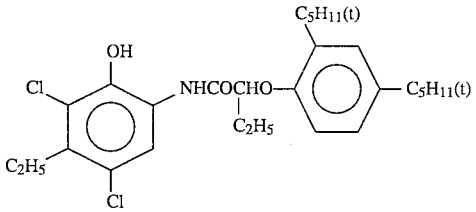
with
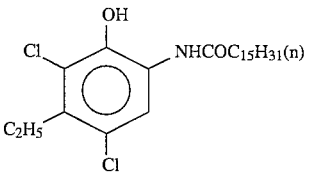

-continued
Cpd-1) Color Image Stabilizer
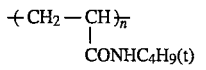
number average molecular weight: 60,000
(Cpd-2) Color Image Stabilizer
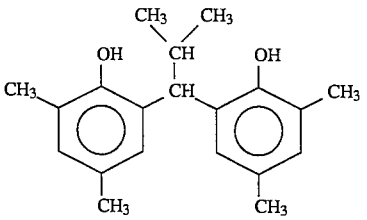
(Cpd-3) Color Image Stabilizer
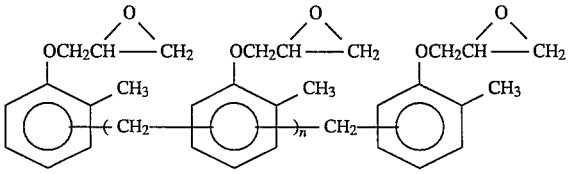
n = 7–8 (average value)
(Cpd-4) Color Mixture Inhibitor
1:1:1 mixture (by weight ratio) of
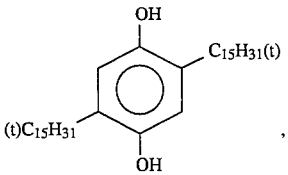
,
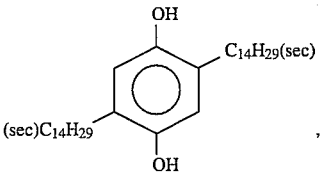
, and
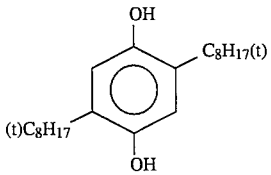
(Cpd-5) Color Image Stabilizer
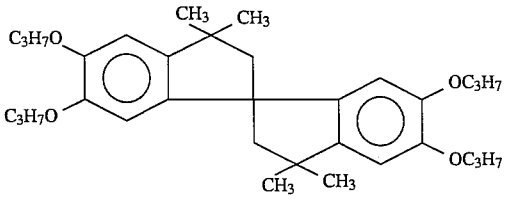

-continued
(Cpd-6) Color Image Stabilizer
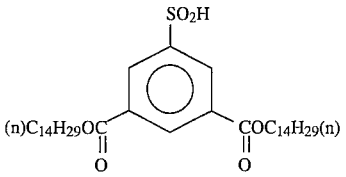
(Cpd-7) Color Image Stabilizer
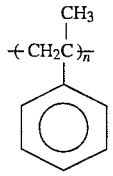
number average molecular weight: 600
(Cpd-8) Color Image Stabilizer
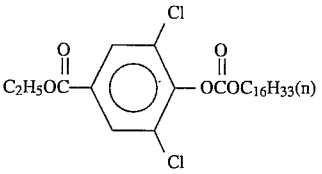
(Cpd-9) Color Image Stabilizer
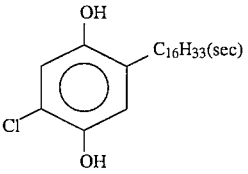
(Cpd-10) Color Image Stabilizer
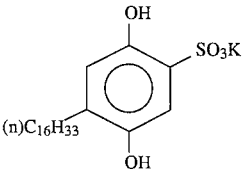
(Cpd-11) Surfactant
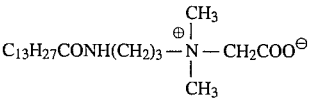

-continued
(Cpd-12) Preservative
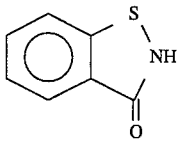
(Cpd-13) Preservative
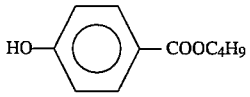
(UV-1) UV Absorbing Agent
1:3:1:3 mixture (by weight ratio) of
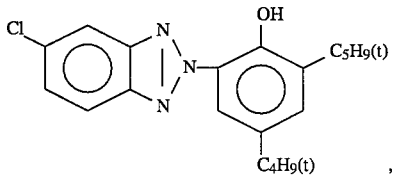
,
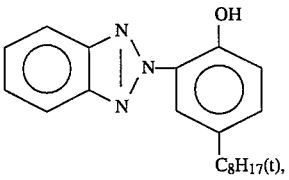
,
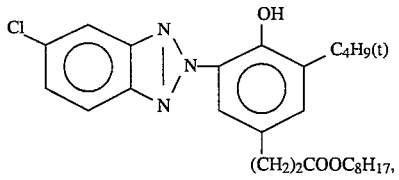
and
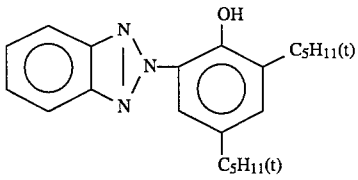
(UV-2) UV Absorbing Agent
2:3:4 mixture (by weight ratio) of
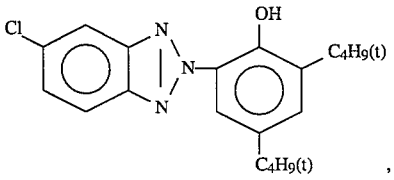
,
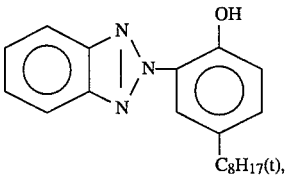
and
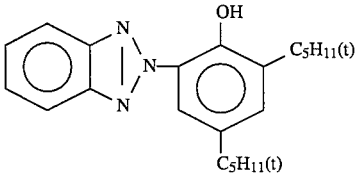
(Solv-1) Solvent
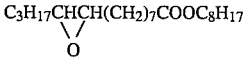
(Solv-2) Solvent
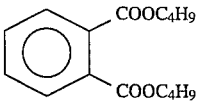

-continued (Solv-3) Solvent

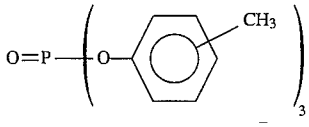

(Solv-4) Solvent $O{=}P{+}O{-}C_6H_{13}(n))_3$ (Solv-5) Solvent

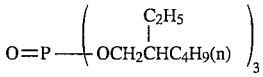

(Solv-6) Solvent $COOC_4H_9$
|
$(CH_2)_8$
|
$COOC_4H_9$ (Solv-7) Solvent

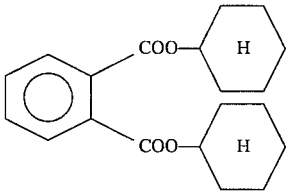

(Solv-8) Solvent

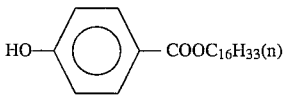

(Solv-9) Solvent $COOC_8H_{17}$
|
$(CH_2)_8$
|
$COOC_8H_{17}$

Samples 101 to 140 were prepared in the same manner as Sample 102 except that yellow coupler (ExY) and color image stabilizers (Cpd-2, Comparative Compound A) included in the first layer of Sample 102 were replaced with the compound of the present invention and the color image stabilizer (discoloration inhibitor) as shown in Table B. The coating amounts of yellow couplers (Y-1), (Y-3), (Y-4), (Y-5) and (Y-7) were changed to 100 mol %, 80 mol %, 75 mol %, 95 mol %, and 75 mol %, respectively, in order to obtain almost the same color densities. Further, the coating amount of silver was changed so as to make the mol ratio per coupler equal. In addition, the color image stabilizer of the present invention was not added to Samples 101, 117, 129, 133 and 137, and regarding other samples, the addition amounts were varied so as to make their mols equal to that of Sample 102.

Above Sample 102 was cut to 127 mm wide and processed to a roll of film. The sample was subjected to an imagewise exposure using a printer processor PP1820V produced by Fuji Photo Film Co., Ltd., and then to a continuous processing (running test) according to the following processing steps, which processing was carried out until the amount of the replenisher became twice the volume of the developing tank.

| Processing Step | Temperature (°C.) | Time (sec) | Amount Replenished* (ml) |
|---|---|---|---|
| Color Development | 38.5 | 45 | 73 |
| Bleach-Fixing | 35 | 45 | 60** |
| Rinsing (1) | 35 | 30 | — |
| Rinsing (2) | 35 | 30 | — |
| Rinsing (3) | 35 | 30 | 360 |
| Drying | 80 | 60 | |

*Amount replenished per $m^2$ of the light-sensitive material.
**In addition to the above 60 ml, 120 ml per $m^2$ the light-sensitive material of the solution was flowed from the rinsing tank (1).
(Rinsing was carried out in a 3-stage countercurrent method of from the rinsing tank (3) to the rinsing tank (1).)

The composition of each processing solution used is described below.

| | Tank Solution | Replenisher |
|---|---|---|
| Color Developing Solution | | |
| Water | 800 ml | 800 ml |
| Ethylenediaminetetraacetic Acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4 Sumitomo Chemical Co., Ltd.) | 1.0 g | 3.0 g |
| Sodium Sulfite | 0.1 g | 0.1 g |
| Diethylhydroxylamine | 5.0 g | 10.0 g |
| Sodium Triisopropyl-naphthalene(β)sulfonate | 0.1 g | 0.1 g |

-continued

| | Tank Solution | Replenisher |
|---|---|---|
| N-Ethyl-N-(β-methanesulfon-amidoethyl)-3-methyl-4-amino-aniline·3/2 Sulfate·Monohydrate | 5.0 g | 11.5 g |
| Water to make | 1,000 ml | 1,000 ml |
| pH (25° C., adjusted with potassium hydroxide and sulfuric acid) | 10.00 | 11.00 |
| Bleach-Fixing Solution | | |
| Water | 600 ml | 150 ml |
| Ammonium Thiosulfate (750 g/liter) | 93 ml | 230 ml |
| Ammonium Sulfite | 40 g | 100 g |
| Ammonium Ethylenediamine-tetraacetato Ferrate | 55 g | 135 g |
| Ethylenediaminetetraacetic Acid | 5 g | 12.5 g |
| Nitric Acid (67%) | 30 g | 65 g |
| Water to make | 1,000 ml | 1,000 ml |
| pH (25° C., adjusted with acetic acid and ammonia water) | 5.8 | 5.6 |
| Rinsing Solution (the tank solution and the replenisher are the same) | | |
| Sodium Chlorinated Isocyanurate | 0.02 g | |
| Deionized Water (electric conductivity: 5 μs/cm or less) | 1,000 ml | |
| pH | 6.5 | |

Samples 101 to 140 were subjected to an imagewise exposure through a blue filter and processed with the above processing solution which had been used in the running test. The processed samples were evaluated on coloring and the light fastness. However, the light discoloration conditions for the light fastness were the use of an Xe light source and irradiation of 80,000 lux for 14 days (intermittent irradiation of 5 hours in the light and 1 hour in the dark).

The results obtained are shown in Table B.

TABLE B

| Sample No. | Coupler | Discoloration Inhibitor (50 mol %) | Color Density (Dmax) | Light Fastness (Xe, 14 days) | Remarks |
|---|---|---|---|---|---|
| 101 | Y-1 (100 mol %) | — | 2.37 | 70 | Comparison |
| 102 | Y-1 (100 mol %) | Comparative Compound A | 2.14 | 85 | " |
| 103 | Y-1 (100 mol %) | Comparative Compound D | 2.21 | 81 | " |
| 104 | Y-1 (100 mol %) | Comparative Compound E | 2.20 | 78 | " |
| 105 | Y-1 (100 mol %) | Comparative Compound F | 1.17 | 75 | " |
| 106 | Y-1 (100 mol %) | Compound 1 | 2.33 | 90 | Invention |
| 107 | Y-1 (100 mol %) | Compound 2 | 2.31 | 92 | " |
| 108 | Y-1 (100 mol %) | Compound 3 | 2.29 | 88 | " |
| 109 | Y-1 (100 mol %) | Compound 4 | 2.32 | 89 | " |
| 110 | Y-1 (100 mol %) | Compound 5 | 2.29 | 87 | " |
| 111 | Y-1 (100 mol %) | Compound 6 | 2.27 | 89 | " |
| 112 | Y-1 (100 mol %) | Compound 9 | 2.37 | 91 | Invention |
| 113 | Y-1 (100 mol %) | Compound 10 | 2.37 | 90 | " |
| 114 | Y-1 (100 mol %) | Compound 11 | 2.31 | 89 | " |
| 115 | Y-1 | Compound 12 | 2.35 | 89 | " |

TABLE B-continued

| Sample No. | Coupler | Discoloration Inhibitor (50 mol %) | Color Density (Dmax) | Light Fastness (Xe, 14 days) | Remarks |
|---|---|---|---|---|---|
| | (100 mol %) | | | | |
| 116 | Y-1 (100 mol %) | Compound 22 | 2.36 | 88 | " |
| 117 | Y-3 (80 mol %) | — | 2.38 | 62 | Comparison |
| 118 | Y-3 (80 mol %) | Comparative Compound A | 2.21 | 81 | " |
| 119 | Y-3 (80 mol %) | Comparative Compound B | 2.24 | 73 | " |
| 120 | Y-3 (80 mol %) | Comparative Compound C | 2.17 | 69 | " |
| 121 | Y-3 (80 mol %) | Compound 1 | 2.36 | 83 | Invention |
| 122 | Y-3 (80 mol %) | Compound 2 | 2.34 | 85 | " |
| 123 | Y-3 (80 mol %) | Compound 9 | 2.38 | 83 | Invention |
| 124 | Y-3 (80 mol %) | Compound 13 | 2.37 | 84 | " |
| 125 | Y-3 (80 mol %) | Compound 14 | 2.35 | 83 | " |
| 126 | Y-3 (80 mol %) | Compound 17 | 2.36 | 81 | " |
| 127 | Y-3 (80 mol %) | Compound 19 | 2.32 | 80 | " |
| 128 | Y-3 (80 mol %) | Compound 22 | 2.38 | 85 | " |
| 129 | Y-5 (95 mol %) | — | 2.41 | 63 | Comparison |
| 130 | Y-5 (95 mol %) | Comparative Compound A | 2.18 | 78 | " |
| 131 | Y-5 (95 mol %) | Compound 2 | 2.33 | 84 | Invention |
| 132 | Y-5 (95 mol %) | Compound 9 | 2.38 | 83 | " |
| 133 | Y-4 (75 mol %) | — | 2.40 | 61 | Comparison |
| 134 | Y-4 (75 mol %) | Comparative Compound A | 2.23 | 80 | Comparison |
| 135 | Y-4 (75 mol %) | Compound 2 | 2.38 | 85 | Invention |
| 136 | Y-4 (75 mol %) | Compound 9 | 2.40 | 84 | |
| 137 | Y-7 (75 mol %) | — | 2.42 | 58 | Comparison |
| 138 | Y-7 (75 mol %) | Comparative Compound A | 2.25 | 78 | " |
| 139 | Y-7 (75 mol %) | Compound 2 | 2.37 | 83 | Invention |
| 140 | Y-7 (75 mol %) | Compound 9 | 2.39 | 87 | " |

Comparative Compound D

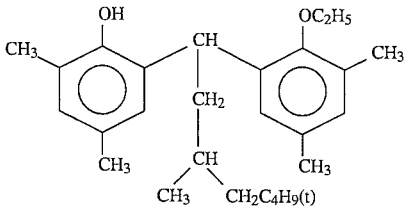

Compound disclosed in JP-A-62-262047 and U.S. Pat. No. 4,782,011

-continued

Comparative Compound E

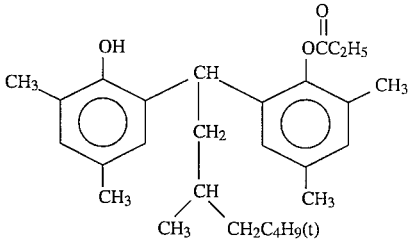

Compound disclosed in JP-A-62-262047 and U.S. Pat. No. 4,782,011

-continued

Comparative Compound F

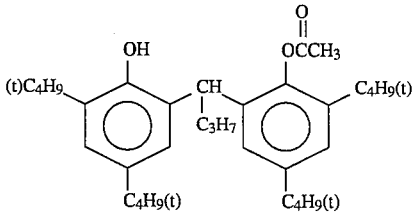

Compound disclosed in JP-A-1-137258

As can be seed from Table B, the discoloration inhibitor of the present invention can improve the light fastness without reduction of color density as in Example 1. Further, when the discoloration inhibitor of the present invention is used, the generation of color turbidity is very little as in Example 1, therefore, the discoloration inhibitor of the present invention is superior also regarding the hue.

EXAMPLE 3

A single-layer coating Sample 201 for evaluation of the layer composition as shown below was prepared using an undercoated polyethylene terephthalate support. The preparation of the coating solution was conducted in the same manner as in Example 1.

| Layer Composition | |
|---|---|
| **Emulsion Layer** | |
| Silver Chlorobromide (containing 70 mol % of silver bromide and sulfur sensitized) | 3.0 mmol/m$^2$ |
| Coupler (C-21) | 0.9 mmol/m$^2$ |
| Discoloration Inhibitor (Cpd-21) | 0.4 g/m$^2$ |
| Discoloration Inhibitor (Cpd-22) | 0.1 g/m$^2$ |
| Solvent (Solv-21) | 0.4 g/m$^2$ |
| Gelatin | 2.5 g/m$^2$ |
| **Protective Layer** | |
| Gelatin | 1.5 g/m$^2$ |
| Copolymer of Acryl-Modified Polyvinyl Alcohol (modification degree: 17%) | 0.3 g |
| Liquid Paraffin | 0.05 g |

Coupler (C-21)

1:1:1 mixture (by mol ratio) of (C-1), (C-2) and (C-4)

Solvent (Solv-21)

1:1 mixture of

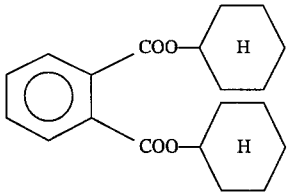

and

-continued

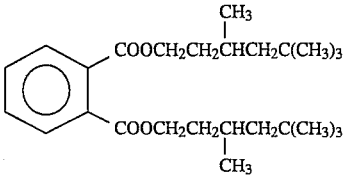

Discoloration Inhibitor (Cpd-21)

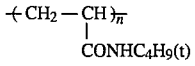

number average molecular weight: 60,000

Discoloration Inhibitor (Cpd-22)

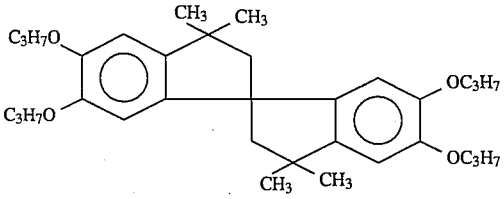

Samples 202 and 203 were then prepared by adding discoloration inhibitors to the emulsion layer of Sample 201 as shown in Table C. The addition amounts are shown in Table C.

These samples were subjected to an imagewise exposure in the same manner as in Example 1 and then processed according to the following processing step.

| Processing Step | Temperature (°C.) | Time (min) |
|---|---|---|
| Color Development | 33 | 2 |
| Bleach-Fixing | 33 | 1.5 |
| Washing | 33 | 3 |

Composition of Processing Solution

| Color Developing Solution | |
|---|---|
| Distilled Water | 800 ml |
| Triethanolamine | 8.1 g |
| Diethylhydroxylamine | 4.2 g |
| Potassium Bromide | 0.6 g |
| Sodium Hydrogencarbonate | 3.9 g |
| Sodium Sulfite | 0.13 g |
| N-Ethyl-N-(β-methanesulfonamido-ethyl)-3-methyl-4-aminoaniline Sulfate | 5.0 g |
| Potassium Carbonate | 18.7 g |
| Water to make | 1,000 ml |
| pH | 10.25 |
| **Bleach-Fixing Solution** | |
| Distilled water | 400 ml |
| Ammonium Thiosulfate (700 g/liter) | 150 ml |
| Sodium Sulfate | 18.0 g |
| Ammonium Ethylenediaminetetraacetato | 55.0 g |

-continued

| | |
|---|---|
| Ferrate | |
| Sodium Ethylenediaminetetraacetate | 5.0 g |
| Water to make | 1,000 ml |
| pH | 6.00 |

The color densities of the processed samples were then measured by red light and maximum color densities (Dmax) were determined. The samples were then irradiated by a Xenon light (80,000 lux, intermittent irradiation of 5 hours in the light and 1 hour in the dark) for 14 days. The light fastness was evaluated from the color remaining rate at an initial density of 1.00. Further, the, heat fastness of the samples was evaluated from the reduction of Dmax after being stored at conditions of 80° C., 60% RH for 28 days.

The results obtained are shown in Table C.

TABLE C

| Sample No. | Discoloration Inhibitor (mol %) | Color Density (Dmax) | Light Fastness (Xe, 14 days) (%) | Heat Fastness (80° C., 60% RH, 28 days) (%) | Remarks |
|---|---|---|---|---|---|
| 201 | — | 2.03 | 70 | 70 | Comparison |
| 202 | Comparative Compound A (20) | 1.83 | 75 | 75 | " |
| 203 | Compound 1 (20) | 2.00 | 80 | 86 | Invention |

As is apparent from Table C, the discoloration inhibitor of the present invention can improve the light fastness and heat without reducing the coloring ability of the cyan coupler.

EXAMPLE 4

Sample 301 was prepared in the same manner as the preparation of Sample 201 of Example 3 except for changing the composition of the emulsion layer of Sample 201 to the following composition.

| Emulsion Layer | |
|---|---|
| Silver Chlorobromide (containing 70 mol % of silver bromide and sulfur sensitized) | 2.4 mmol/m$^2$ |
| Coupler (M-31) | 0.6 mmol/m$^2$ |
| Discoloration Inhibitor (Cpd-31) | 0.3 mmol/m$^2$ |
| Discoloration Inhibitor (Cpd-32) | 0.2 mmol/m$^2$ |
| Solvent (Solv-31) | 0.9 g/m$^2$ |
| Gelatin | 2.5 g/m$^2$ |

(M-31)

1:1 mixture (by mol ratio) of (M-1) and (M-10)

(Solv-31)

1:1:1 mixture (by weight ratio) of

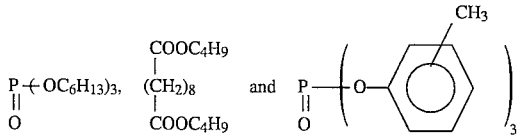

-continued (Cpd-31)

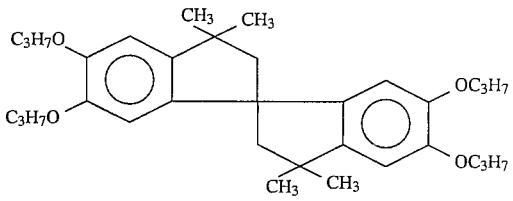

-continued (Cpd-32)

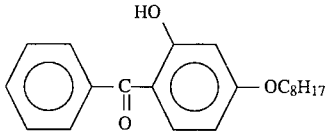

Samples 302 and 303 containing the discoloration inhibitors were prepared as shown in Table D. The amount added of each sample are shown in Table D.

After subjecting to an imagewise exposure, these samples were processed in the same manner as in Example 3. The color densities of the processed samples were then measured by green light and the color remaining rate after light irradiation was evaluated in the same manner as in Example 3. The results obtained are shown in Table D.

TABLE D

| Sample No. | Discoloration Inhibitor (mol %) | Color Density (Dmax) | Light Fastness (Xe, 14 days) (%) | Remarks |
|---|---|---|---|---|
| 301 | — | 2.42 | 78 | Comparison |
| 302 | Comparative Compound A (20) | 2.33 | 85 | " |
| 303 | Compound 1 (20) | 2.40 | 90 | Invention |

Comparative Compound A was the same as that used in

Example 1.

As is apparent from Table D, the discoloration inhibitor of the present invention can improve the light fastness without reducing the coloring ability of the magenta coupler.

The stability of color images can be improved without reducing coloring and hue by the present invention.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having thereon at least one layer containing at least one compound represented by formula (I):

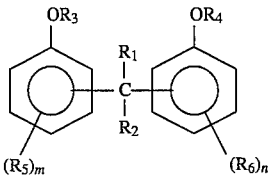

(I)

wherein $R_1$, $R_2$, and $R_4$ each represents a hydrogen atom or a substituent; $R_3$ represents a hydrogen atom; $R_5$ and $R_6$ each represents a substituent; m and n each represents an integer of from 0 to 4; provided that said compound of formula (I) has a phosphonic acid ester moiety of the formula

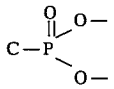

or a phosphonic acid amide moiety of the formula

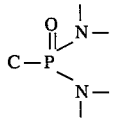

wherein the carbon atom of the C-P bond contained in said moiety (i) constitutes a part of the skeleton of said compound of formula (I), said skeleton being represented by formula (A)

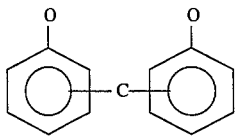

(A)

or (ii) is contained in a substituent group represented by $R_1$, $R_2$, $R_4$, $R_5$, or $R_6$; wherein two or more of $R_1$, $R_2$, $R_4$, $R_5$ and $R_6$ may combine with said phosphonic acid ester or amide moiety to form a ring.

2. The silver halide color photographic material as claimed in claim 1, wherein said compound represented by formula (I) represents a compound represented by formula (I-1), (I-2), (I-4), (I-5) or (I-6):

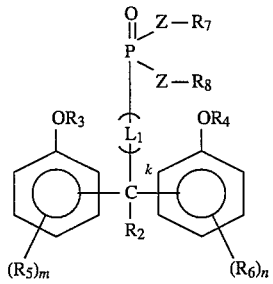

(I-1)

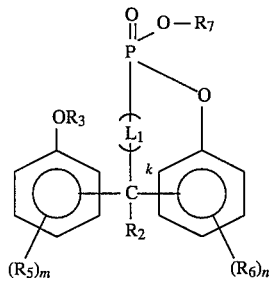

(I-2)

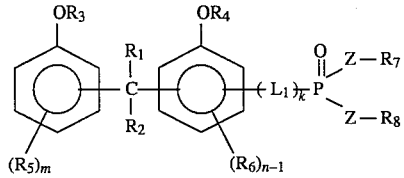

(I-4)

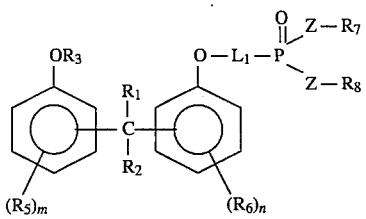

(I-5)

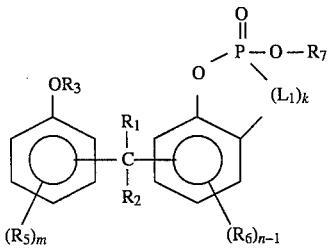

(I-6)

wherein $R_1$, $R_2$, and $R_4$ each represents a hydrogen atom or a substituent; $R_3$ represents a hydrogen atom; $R_5$ and $R_6$ each represents a substituent; m and n each represents an integer of from 0 to 4; $L_1$ represents a divalent linking group; k represents an integer of 0 or 1; Z represents —O— or —N—($R_9$)—; $R_7$, $R_8$ and $R_9$ each represents an alkyl group, a cycloalkyl group, an alkenyl group, or an aryl group; in each formula, at least two of $R_1$, $R_2$, $R_4$, $R_5$, $R_6$, $R_7$, $R_8$ and $R_9$ may be bonded to each other to form a ring.

3. The silver halide color photographic material as claimed in claim 2, wherein $L_1$ represents an alkylene group, an alkenylene group, a cycloalkylene group or an arylene group.

4. The silver halide color photographic material as claimed in claim 2, wherein Z is —O—.

5. The silver halide color photographic material as claimed in claim 1, wherein said substituent of $R_1$, $R_2$, $R_4$, $R_5$, and $R_6$, each represents a halogen atom, an alkyl group, an alkenyl group, a cycloalkyl group, an aryl group, a heterocyclic group, an acyl group, an acyloxy group, an acylamino group, an alkoxy group, an aryloxy group, an alkoxycarbonyl group, an aryloxycarbonyl group, a carbamoyl group, a sulfonyl group, a sulfonyloxy group, a sulfamoyl group, a sulfonamide group, an amino group, an alkoxycarbonylamino group, an aryloxycarbonylamino group, a sulfinyl group, an alkylthio group, an arylthio group, a hydroxy group, a cyano group, a nitro group, a sulfo group, a carbamoylamino group, a sulfamoylamino group, a sulfamoylcarbamoyl group, a carbamoylsulfamoyl group, a dialkyloxyphosphinyl group, a diaryloxyphosphinyl group, a dialkenyloxyphosphinyl group, dicycloalkyloxyphosphinyl group, a diaminophosphinyl group, and a phosphino group.

6. The silver halide color photographic material as claimed in claim 1, wherein $R_2$ is a hydrogen atom.

7. The silver halide color photographic material as claimed in claim 1, wherein the carbon atom by which $R_1$ and $R_2$ are connected bonds to each benzene ring at the ortho-position or para-position thereof to the —$OR_3$ group and the —$OR_4$ group.

8. The silver halide color photographic material as claimed in claim 1, wherein the carbon atom by which $R_1$and $R_2$ are connected bonds to each benzene ring at the ortho-position thereof to the —$OR_3$ group and the —$OR_4$ group.

9. The silver halide color photographic material as claimed in claim 1, wherein said at least one compound is used in an amount of 0.0002 to 20 g per $m^2$ of the photographic material.

10. The silver halide color photographic material as claimed in claim 1, wherein said compound of formula (I) is contained in a silver halide emulsion layer.

11. The silver halide color photographic material as claimed in claim 1, wherein said layer containing said compound of formula (I) further contains a cyan coupler, a magenta coupler, or a yellow coupler.

* * * * *